US006826374B2

(12) United States Patent
Kato et al.

(10) Patent No.: US 6,826,374 B2
(45) Date of Patent: Nov. 30, 2004

(54) SHEET PROCESSING APPARATUS WITH DISCHARGE SHEET COVER AND CONTROL BASED ON OPEN/CLOSE STATE OF COVER

(75) Inventors: Hitoshi Kato, Ibaraki (JP); Yuji Morishige, Ibaraki (JP); Norifumi Miyake, Chiba (JP); Yasuo Fukazu, Chiba (JP); Yuzo Matsumoto, Ibaraki (JP); Yusuke Obuchi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 10/230,224

(22) Filed: Aug. 29, 2002

(65) Prior Publication Data

US 2003/0044186 A1 Mar. 6, 2003

(30) Foreign Application Priority Data

Aug. 31, 2001 (JP) ..... 2001-264129
Aug. 31, 2001 (JP) ..... 2001-264130

(51) Int. Cl.[7] ..... G03G 15/00
(52) U.S. Cl. ..... 399/16; 399/405
(58) Field of Search ..... 399/404, 405, 399/407, 403, 16

(56) References Cited

U.S. PATENT DOCUMENTS 5,042,793 A 8/1991 Miyake ..... 271/293
5,100,119 A 3/1992 Komada et al. ..... 270/53
5,299,795 A 4/1994 Miyake ..... 271/9
5,390,016 A 2/1995 Hoshi et al.
5,455,667 A 10/1995 Hiroi et al.
5,580,039 A 12/1996 Takehara et al. ..... 270/58.11
6,021,305 A 2/2000 Sato et al. ..... 399/374
6,219,503 B1 4/2001 Miyake et al. ..... 399/85
6,353,726 B1 3/2002 Murata et al. ..... 399/407
6,371,472 B1 4/2002 Miyake et al. ..... 370/58.14
6,386,080 B1 5/2002 Okamoto et al. ..... 83/73
6,393,232 B1 * 5/2002 Osari et al. ..... 399/405

FOREIGN PATENT DOCUMENTS

JP 9-73205 3/1997
JP 9-77354 3/1997
JP 9-297493 11/1997
JP 2001-153955 6/2001

* cited by examiner

*Primary Examiner*—Susan Lee
(74) *Attorney, Agent, or Firm*—Fitzpatrick, Cella, Harper & Scinto

(57) ABSTRACT

A sheet processing apparatus has a sheet conveyor and sheet processing unit for performing a predetermined process to the sheet conveyed by that sheet conveyor. A sheet discharger discharges the processed sheet to a stacking unit, the unit having a cover which may be opened or closed and which includes a detector for detecting whether or not the cover is opened and closed, and a controller will immediately stop, in a case where the discharge process to the sheet that is performed by the discharge unit, driving of the sheet discharge unit and sheet conveyor when it is detected that the cover is opened and for continuing, in a case where the discharge process to the sheet is not performed by the sheet discharge unit, the driving of the sheet conveyor in spite of the detection that the cover is open.

4 Claims, 21 Drawing Sheets

SHEET PROCESSING APPARATUS WITH DISCHARGE SHEET COVER AND CONTROL BASED ON OPEN/CLOSE STATE OF COVER

BACKGROUND OF THE INVENTION

1. Field of the Invention

The present invention relates to a sheet processing apparatus which is used in image forming apparatuses such as a copying machine, a laser beam printer and the like.

2. Related Background Art

In conventional sheet processing apparatuses, there is an apparatus in which, in order to prevent a user from touching an operating unit while the sheet processing apparatus is operating, a cover is provided on a processing unit that processes sheets and also a cover (called a stack cover hereinafter) is mounted on a stack tray that stacks the sheets processed by the processing unit.

In the apparatuses equipped with the stack cover, there is an apparatus in which a mechanism of, if the stack cover is opened, stopping by a microswitch or the like a driving circuit of the operating unit which might be touched by the user, and, if the stack cover is opened while the sheet processing apparatus is operating, an overall apparatus including an image forming apparatus is set to be in a jam state to stop a sheet process and sheet conveying so as to prevent the sheet from being conveyed to the operating unit of which the driving circuit is stopped.

Moreover, there is an apparatus in which a lock mechanism of causing the stack cover not to be opened while the sheet processing apparatus is operating.

In the apparatus including the lock mechanism, post-processed sheets can not be taken out while the sheet processing apparatus is operating. Thus, there is provided an apparatus in which the image forming apparatus and the sheet processing apparatus are temporarily stopped by depressing a key for stopping the operation, and the sheets can be then taken out.

In a case where a user who ordinarily uses the sheet processing apparatus to perform simple bookbinding performs a large amount of bookbinding processes, there is a demand to take out the sheets to which the bookbinding process ended, at any time.

However, in the conventional apparatus that sets the overall apparatus including the main body of the image forming apparatus to be in the jam state merely if the stack cover is opened while the sheet processing apparatus is operating, the sheet processing apparatus is immediately set to be in the jam state, whenever the stack cover is opened while the apparatus is operating, so as to take out the processed sheets. For this reason, there occurs problems that plural sheets being processed are wasted and also it forces the user to execute the extra amount of work due to a jam process.

Moreover, in the apparatus in which the stack cover can not be opened while the sheet processing apparatus is operating, the apparatus is set to be in the jam state if the stack cover is opened, whereby it does not force the user to execute any extra amount of work. However, there is a problem that it is impossible to fulfill the demand to take out at any time the sheets to which the process ended while the sheet processing apparatus is operating.

Therefore, it is desirable to provide a sheet processing apparatus in which, even while the sheet processing apparatus is operating, the processed sheets can be taken out by opening the stack cover without easily setting the jam state, and moreover, the discharge unit of the sheet processing apparatus is stopped in consideration of safety when the sheets are actually taken out of the apparatus.

In the apparatus of this type, when the user erroneously leaves the stack cover open, since bundles of sheets are sequentially supplied from the image forming apparatus to the sheet processing apparatus of which the sheet discharge unit is at a standstill in consideration of safety, many bundles are resultingly stacked within the sheet processing apparatus, whereby the sheet processing apparatus comes to be in the jam state or other abnormal state. Since the sheets are forcedly conveyed to the standstill sheet processing apparatus, a process to eliminate the jammed sheets becomes difficult and the breakdown of apparatus is caused in the worst case.

Moreover, in the apparatus in which image forming apparatus and the sheet processing apparatus are stopped by depressing a stop key and then the sheets can be taken out, it is possible to fulfill the demand of sequentially taking out at any time the sheets to which the process has ended while the sheet processing apparatus is operating. However, there is a problem that, since it is permitted to take out the sheets after once performing an interruption process in the image forming apparatus and the sheet processing apparatus, a standstill time of the sheet processing apparatus is thus prolonged, whereby productivity is remarkably decreased.

SUMMARY OF THE INVENTION

An object of the present invention is, or satisfying a demand to take out at any time sheets to which a sheet process has ended, as improving safety, when the sheets are taken out of a stack tray while a sheet processing apparatus is operating, to set a state of enabling a user to take the sheets out of the stack tray as many as possible, and moreover, to eliminate a jam that can be hardly removed.

Another object of the present invention is to satisfy the demand to take out at any time sheets to which a sheet process has been performed, as improving safety, when the sheets are taken out of a stack tray while a sheet processing apparatus is operating, to set a state of enabling a user to take as many of the sheets as possible out of the stack tray, and moreover, not to decrease productivity of the sheet processing apparatus by avoiding interruption of the sheet processing apparatus as much as possible when the sheets are taken out.

The present invention also comprises a sheet conveying means for conveying a sheet from a first region to a second region; a sheet processing means for performing a predetermined process to the sheet conveyed by the sheet conveying means; a stack means for stacking the sheets processed by the sheet processing means; a cover means for covering the stack means; an open/close detecting means for detecting whether the cover means is opened or closed; and a control means for causing, in a case where the sheet exists in the second region, the sheet to stop in the second region as an abnormality according to the detection by the open/close detecting means that the cover means is opened, and for causing, in a case where the sheet does not exist in the second region, the conveyed sheet to temporarily stop in the first region according to the detection by the open/close detecting means that the cover means is opened, and restarting the conveying of the sheet temporarily stopped in the first region according to the detection by the open/close detecting means that the cover means is closed.

Moreover, the present invention is characterized in that the second region is the region where the sheet processed by the sheet processing means is discharged toward the stack means.

Moreover, the present invention is characterized in that, in the case where the sheet does not exist in the second region, a predetermined sheet process is continued to the end even though the cover means is opened.

Moreover, the present invention is characterized in that, in the case where the sheet does not exist in the second region, the sheet conveyed to the first region is shifted to a predetermined position shifted toward the second region in the first region according to the detection by the open/close detecting means that the cover means is opened.

Moreover, the present invention is characterized in that the predetermined position in the first region is the position where a predetermined sheet process has ended.

Moreover, the present invention is characterized in that the predetermined process is a cutout process to cut out the end of the sheet.

Moreover, the present invention is characterized in that the sheet processing apparatus is an image forming apparatus.

Moreover, the present invention also comprises a sheet conveying means for conveying a sheet; a sheet processing means for performing a predetermined process to the sheet conveyed by the sheet conveying means; a sheet discharge means for performing a discharge process to the sheet processed by the sheet processing means; a stack means for stacking the sheets discharged by the sheet discharge means; a cover means for covering the stack means; an open/close detecting means for detecting whether the cover means is opened or closed; and a control means for immediately stopping, in a case where the discharge process to the sheet is performed by the sheet discharge means, driving of the sheet discharge means and the sheet conveying means according to the detection by the open/close detecting means that the cover means is opened, and for continuing, in a case where the discharge process to the sheet is not performed by the sheet discharge means, the driving of the sheet conveying means no matter the detection by the open/close detecting means that the cover means is opened.

Moreover, the present invention is characterized in that the predetermined process is a cutout process to cut out the end of the sheet.

Moreover, the present invention is characterized in that the sheet processing apparatus is an image forming apparatus.

Moreover, the present invention also comprises a sheet conveying means for conveying a sheet; a sheet processing means for performing a predetermined process to the sheet conveyed by the sheet conveying means; a sheet discharge means for performing a discharge process to the sheet processed by the sheet processing means; a stack means for stacking the sheets discharged by the sheet discharge means; a cover means for covering the stack means; an open/close detecting means for detecting whether the cover means is opened or closed; and a control means for immediately stopping, in a case where the discharge process to the sheet is performed by the sheet discharge means, driving of the sheet discharge means and the sheet conveying means according to the detection by the open/close detecting means that the cover means is opened, and for continuing, in a case where the discharge process to the sheet is not performed by the sheet discharge means, the driving of the sheet conveying means until the sheet is conveyed to a predetermined position before the process by the sheet discharge means and stopping the driving of the sheet processing means after the predetermined process is performed to the sheet, according to the detection by the open/close detecting means that the cover means is opened.

Moreover, the present invention is characterized in that the predetermined process is a cutout process to cut out the end of the sheet.

Moreover, the present invention is characterized in that the sheet processing apparatus is an image forming apparatus.

Moreover, the present invention is characterized by an image forming system which conveys a recording sheet from a first sheet processing apparatus for performing a sheet process to the sheet discharged from an image forming apparatus to a second sheet processing apparatus for performing a sheet process different from the sheet process performed by the first sheet processing apparatus, the system comprising a communication means for communicating a timing signal representing the conveying of the sheet from the first sheet processing apparatus to the second sheet processing apparatus, wherein, in a case where the timing signal is communicated while the second sheet processing apparatus is stopped, the first sheet processing apparatus is stopped.

Moreover, the present invention is characterized by an image forming system which conveys a recording sheet from a first sheet processing apparatus for performing a sheet process to the sheet discharged from an image forming apparatus, to a second sheet processing apparatus for performing a sheet process different from the sheet process performed by the first sheet processing apparatus, the system comprising: a communication means for communicating a timing signal representing the conveying of the sheet from the first sheet processing apparatus to the second sheet processing apparatus; a cover means for covering a stack means for stacking the sheets processed by the second sheet processing apparatus; and an open/close detecting means for detecting whether the cover means is opened or closed, wherein, in a case where the second sheet processing apparatus is standstill according to the detection by the open/close detecting means that the cover means is opened, the first sheet processing apparatus is stopped when the timing signal is communicated.

Moreover, the present invention is characterized in that, in the case where the second sheet processing apparatus is stopped, the image forming operation is stopped according to the end of entire recording on arbitrary one recording sheet.

Moreover, the present invention is characterized in that the arbitrary one recording sheet is set at a predetermined position of the first sheet processing apparatus.

Moreover, the present invention is characterized by an image forming system which conveys a recording sheet from a first sheet processing apparatus for performing a sheet process to the sheet discharged from an image forming apparatus, to a second sheet processing apparatus for performing a sheet process different from the sheet process performed by the first sheet processing apparatus, the system comprising: a cover means for covering a stack means for stacking the sheets processed by the second sheet processing apparatus; and an open/close detecting means for detecting whether the cover means is opened or closed, wherein, in a case where the second sheet processing apparatus is stopped according to the detection by the open/close detecting means that the cover means is opened, an image forming operation is stopped at predetermined timing.

Moreover, the present invention is characterized in that, in the case where the second sheet processing apparatus is stopped, the image forming operation is stopped according to the end of entire recording on arbitrary one recording sheet.

Moreover, the present invention is characterized in that the arbitrary one recording sheet is set at a predetermined position of the first sheet processing apparatus.

Moreover, the present invention is characterized by an image forming system which conveys a recording sheet from a first sheet processing apparatus for performing a sheet process to the sheet discharged from an image forming apparatus, to a second sheet processing apparatus for performing a sheet process different from the sheet process performed by the first sheet processing apparatus, the system comprising: a cover means for covering a stack means for stacking the sheets processed by the second sheet processing apparatus; and an open/close detecting means for detecting whether the cover means is opened or closed, wherein an image forming operation is stopped at predetermined timing according to the detection by the open/close detecting means that the cover means is opened, and the image forming operation is restarted according to the detection by the open/close detecting means that the cover means is closed.

Moreover, the present invention is characterized in that, in a case where the second sheet processing apparatus is stopped, the image forming operation is stopped according to the end of entire recording on arbitrary one recording sheet.

Moreover, the present invention is characterized in that the arbitrary one recording sheet is set at a predetermined position of the first sheet processing apparatus.

Moreover, the present invention is characterized by a first sheet processing apparatus which constitutes an image forming system for conveying a recording sheet from the first sheet processing apparatus performing a sheet process to the sheet discharged from an image forming apparatus, to a second sheet processing apparatus performing a sheet process different from the sheet process performed by the first sheet processing apparatus, the first sheet processing apparatus comprising: a sheet conveying means for conveying the sheet; and a communication means for communicating a timing signal representing the conveying of the sheet to the second sheet processing apparatus, wherein, when the communication means communicates the timing signal, driving of the sheet conveying means is stopped if the second sheet processing apparatus is standstill.

Moreover, the present invention is characterized by an image forming apparatus which is connected to a first sheet processing apparatus and also connected to a second sheet processing apparatus through the first sheet processing apparatus, wherein, when the second sheet processing apparatus is stopped, an image forming operation is stopped at predetermined timing.

Moreover, the present invention is characterized in that, when the second sheet processing apparatus is stopped, the image forming operation is stopped according to the completion of the recording on arbitrary one sheet.

Moreover, the present invention is characterized in that, when the second sheet processing apparatus is stopped, the image forming operation is stopped at a break between a job and a job after the second sheet processing apparatus is stopped.

The above objects and effects and other objects and effects will be apparent in conjunction with the explanation using the following drawings.

DESCRIPTION OF THE PREFERRED EMBODIMENT

Figure 1:
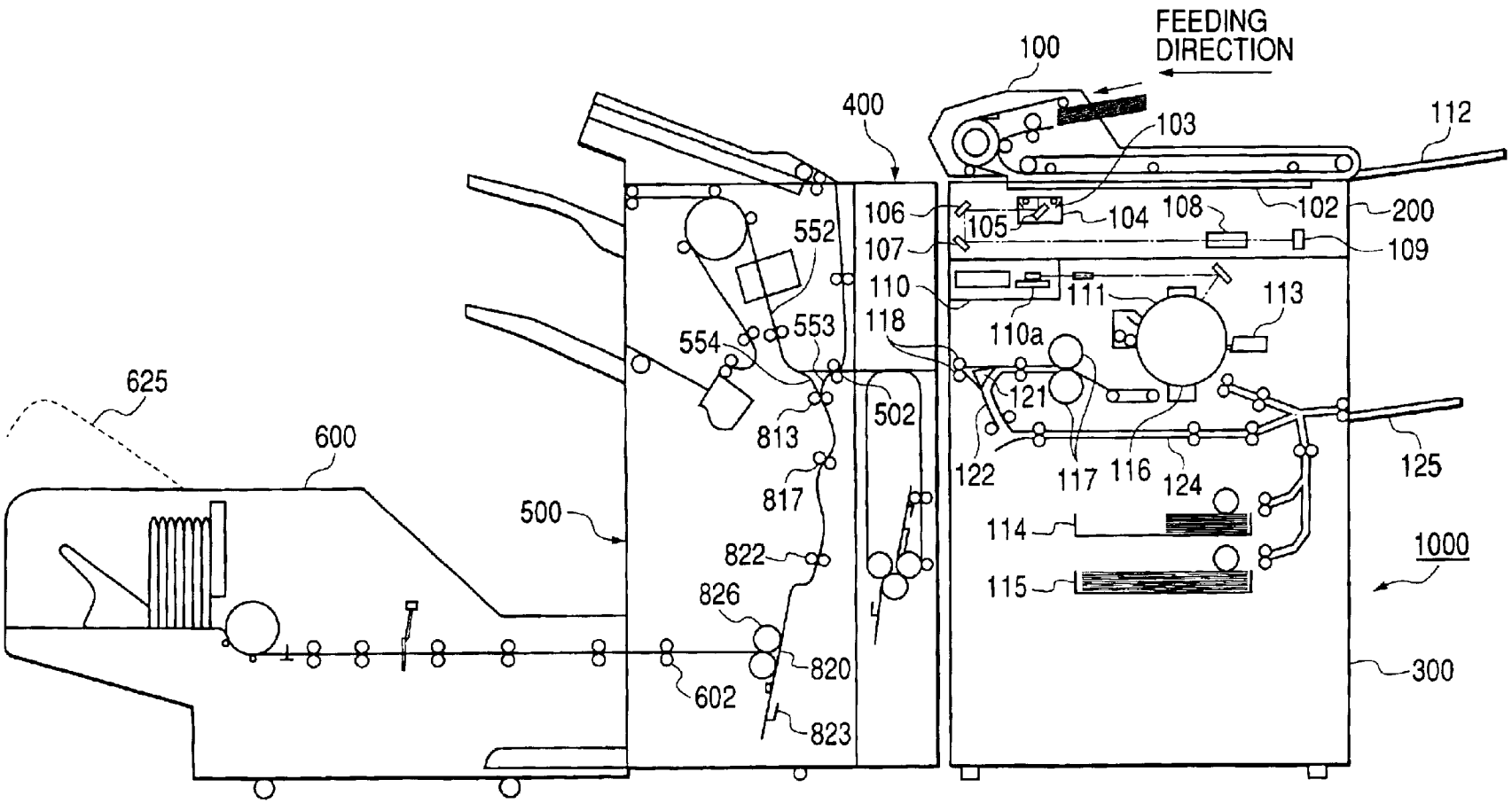
FIG. 1 is a sectional view showing the structure of an image forming apparatus.

FIG. 1 is a sectional view showing the internal structure of an image forming apparatus 1000 according to an embodiment of the present invention.

The image forming apparatus 1000 includes a sheet (original) feeder 100, an image reader 200, a printer unit 300, a folder 400, a finisher 500 and a trimmer 600.

In the sheet feeder 100, originals (faceup) set on an original mounting board are conveyed from a top page one by one in due order from left to right on a platen glass 102 through a curved path and then discharged to an original discharge tray 112.

At this time, the image reader 200 is operated as follows. That is, a scanner unit 104 is being maintained at a predetermined position, and the original passes from left to right on the scanner unit 104, whereby the original is read.

When the original passes on the scanner unit 104, light from a lamp 103 of the scanner unit 104 is irradiated on the original, and reflection light from the original is introduced into an image sensor 109 through mirrors 105, 106 and 107 and a lens 108. Incidentally, the original may be read by shifting the scanner unit 104 from left to right in the state that the original is fixed, after the original is conveyed onto the platen glass 102 by the sheet feeder 100.

Next, the operation of the printer unit 300 will be explained hereinafter. An image of the original read by the image sensor 109 is subjected to an image process and then sent to an exposure control unit 110 which outputs a laser beam according to an image signal. The output laser beam is irradiated on a photosensitive drum 111, whereby an electrostatic latent image is formed on the photosensitive drum 111. Then, the electrostatic latent image on the photosensitive drum 111 is developed by a developing unit 113, and developing agents on the photosensitive drum 111 are transferred by a transfer unit 116 to a sheet fed from either one of cassettes 114 and 115, a manual feed unit 125 and a both-side conveying path 124.

When a sheet is fed from the manual feed unit 125 or the cassette 114, 115, it is possible, from an operation unit 1 (FIG. 2), by the user to set a kind of the sheet, e.g., a thick sheet, an OHP sheet and the like, whereby an optimum conveying condition and an image forming condition are selected according to the kind of sheet.

The sheet to which the developing agents have been transferred is subjected to a fixing process by a fixing unit 117, and the sheet passed the fixing unit 117 is once introduced into a path 122 by a flapper 121. Then, after the trailing edge of the sheet passes the flapper 121, the sheet is switched back and introduced to discharge rollers 118 by the flapper 121.

Thus, the sheet is discharged from the printer unit 300 by the discharge rollers 118 in the state that the surface to which the developing agents have been transferred is facedown.

The sheet discharged through the discharge rollers 118 are conveyed to the folder 400 which performs a folding process for folding the sheet like a Z shape. Here, if an A3 sheet or a B4 sheet is used and the folding process is designated, the folding process is performed by the folder 400. On the other hand, if the folding process is not performed, the sheet is conveyed to the finisher 500 as it is.

The finisher 500 includes a pair of input rollers 502 for introducing the sheet discharged from the printer unit 300 through the folder 400 into the finisher 500. A transfer flapper for introducing the sheet to a finisher path 552 or a first bookbinding path 553 is provided at the downstream side of the pair of input rollers 502.

The sheet conveyed from the first bookbinding path 553 or a second bookbinding path 554 is held in a holding guide 820 by a pair of first conveying rollers 813 and a pair of second conveying rollers 817, and the sheet is further conveyed by a pair of third conveying rollers 822 until the leading edge of the sheet comes into contact with a movable sheet positioning member 823. Moreover, not-shown two pairs of staplers are provided at the downstream side along the conveying direction by the second conveying rollers 817, whereby the staplers can cooperate with a not-shown anvil disposed opposite to the staplers to staple the center of the bundle of sheets (saddle stitch binding).

Moreover, a pair of folding rollers 826 is provided nearby the staplers to fold the bundle of sheets extruded by a not-shown extruding member. After then, the folded bundle of sheets is conveyed to the trimmer 600, and the edge of the bundle conveyed from the finisher 500 is cut out by the trimmer 600 in accordance with operator's setting sent from the operation unit of the image forming apparatus 1000 or the printer driver.

Then, the user opens a stack cover 625 upward and takes out the bundle of sheets subjected to the saddle stitch bookbinding process.

By doing so, the image forming apparatus 1000 can provide the bundle of sheets which has been subjected to the saddle stitch bookbinding and of which the edge portion is cut and aligned like magazines and weekly magazines generally sold.

Structure of Each Control Unit

Figure 2:
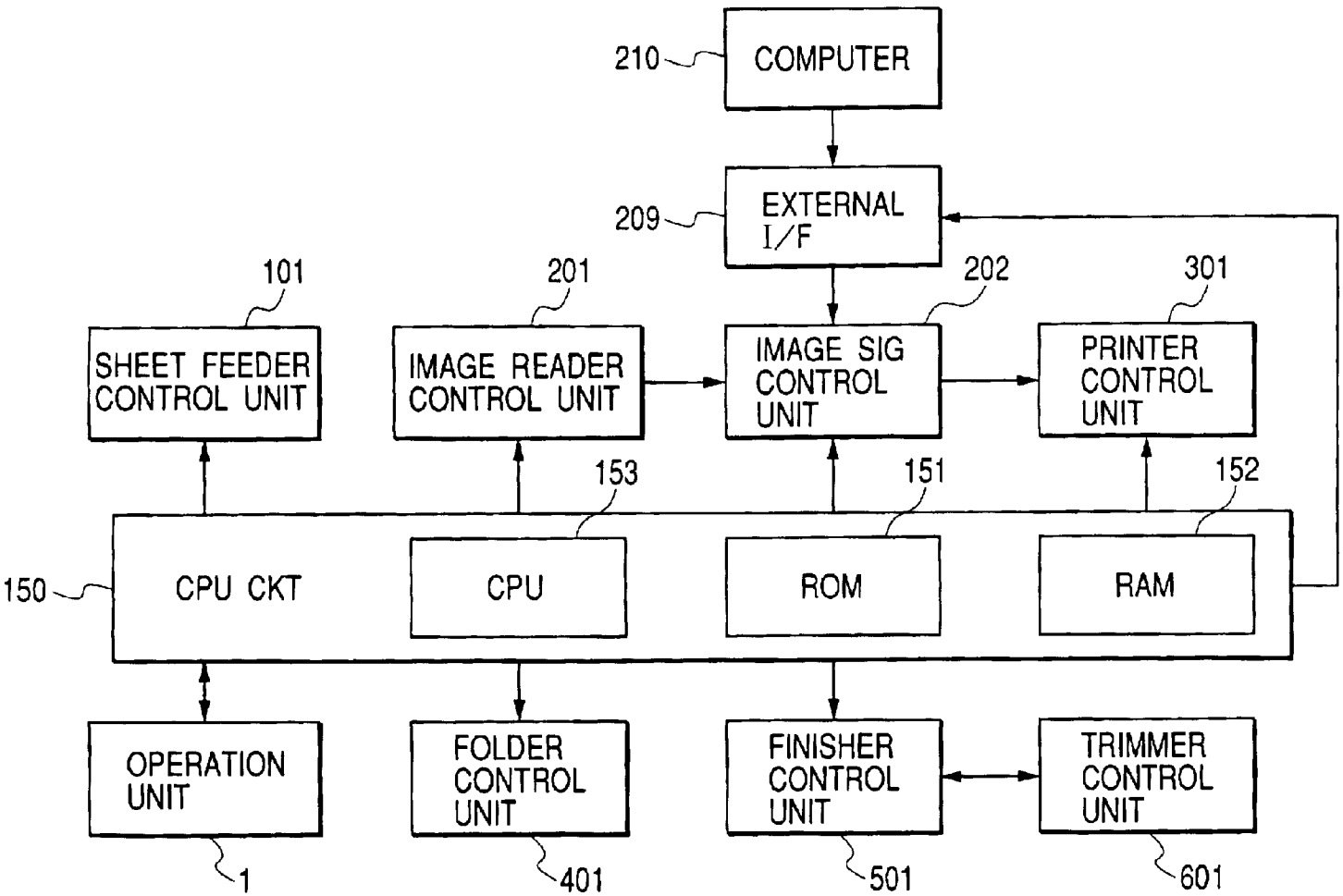
FIG. 2 is a block diagram showing a control unit of the image forming apparatus.

As shown in FIG. 2, the structure of the control unit included in the image forming apparatus 1000 is as follows. First, an image forming circuit unit 150 includes a CPU 153, and the CPU 153 controls a sheet feeder control unit 101, an image reader control unit 201, an image signal control unit 202, a printer control unit 301, a folder control unit 401, a finisher control unit 501 and an external I/F (interface) 209 in accordance with programs stored in a ROM 151 and the setting on the control unit 1. Here, the sheet feeder control unit 101 controls the sheet feeder 100, the image reader control unit 201 controls the image reader 200, the printer control unit 301 controls the printer unit 300, the folder control unit 401 controls the folder 400, the finisher control unit 501 controls the finisher 500, and a trimmer control unit 601 controls the trimmer 600.

A RAM 152 is used as an area temporarily storing control data and a working area for calculation based on the control. The external I/F 209 interfaces with a computer 210 to develop print data into image data and output the developed image data to the image signal control unit 202. The image data read by the image sensor 109 is output from the image reader control unit 201 to the image signal control unit 202 and further to the printer control unit 301, whereby the image is formed.

Explanation of Structure and Operation of Trimmer

The operation of the trimmer 600 will be explained in detail with reference to FIGS. 3 to 9.

Figure 3:
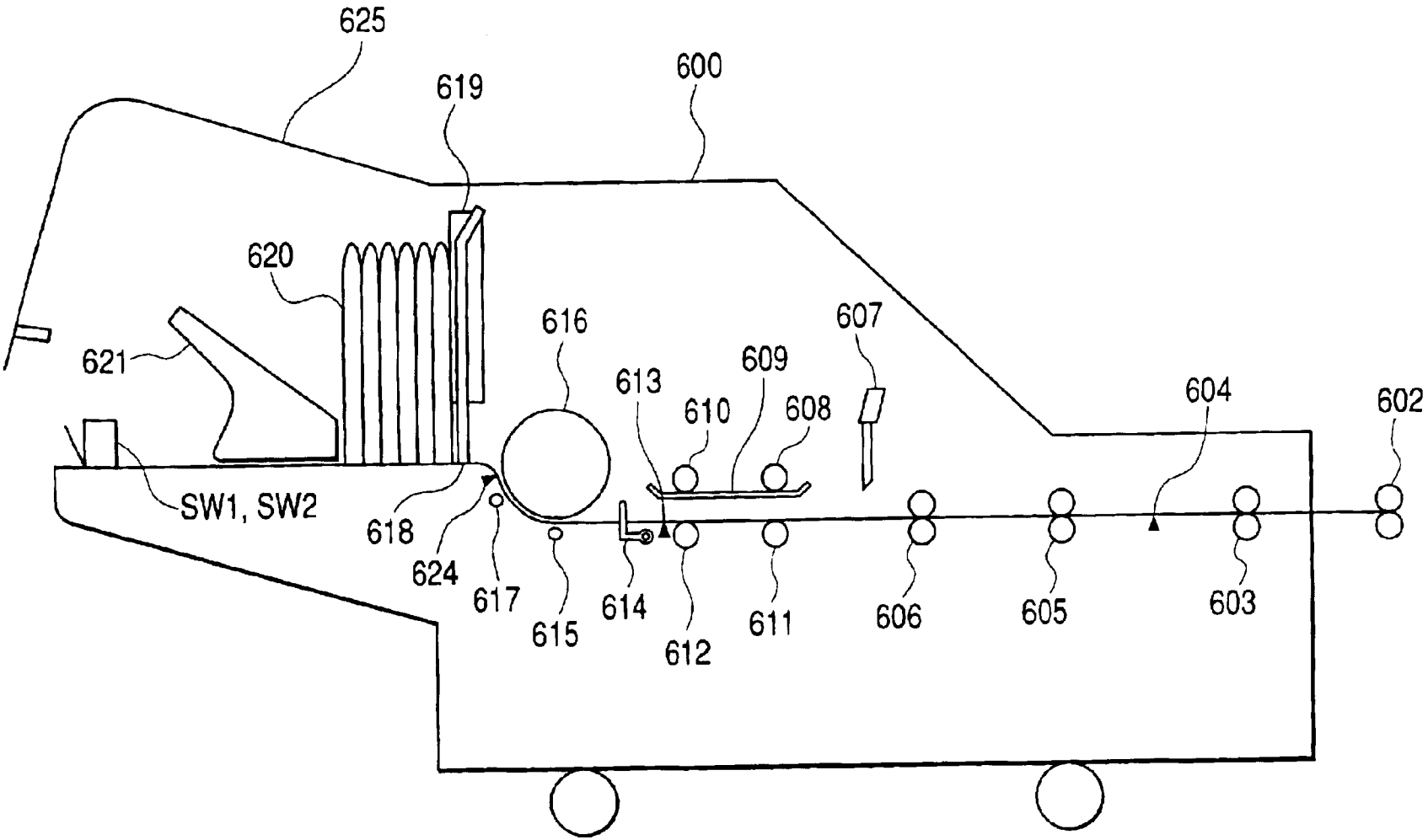
FIG. 3 is a sectional view showing an operation of a trimmer device.

As shown in FIG. 3, in a standby state, bundles 620 of sheets (hereinafter called sheet bundles 620) already stacked are pressed and held by a not-shown spring between a pusher plate 619 and a stack tray 621. Then, in the standby state, if information representing the sheet size of a bundle 622 of sheets (hereinafter called a sheet bundle 622) to be next accepted is issued by the printer control unit 301, a stopper 614 is shifted based on the issued information by a not-shown stopper motor M25 to an optimum position (i.e., the position according to the sheet size) where the edge of the bundle is cut out by a cutter 607.

The sheet bundle 622 saddle-stitch-bound and folded by a bookbinding unit (a saddle stitch binding processing unit) passes an input roller 602 and is conveyed by conveying rollers 603, 605, 606, 611 and 612, and then the sheet bundle 622 is bumped against the stopper 614 for oblique correction.

Figure 4:
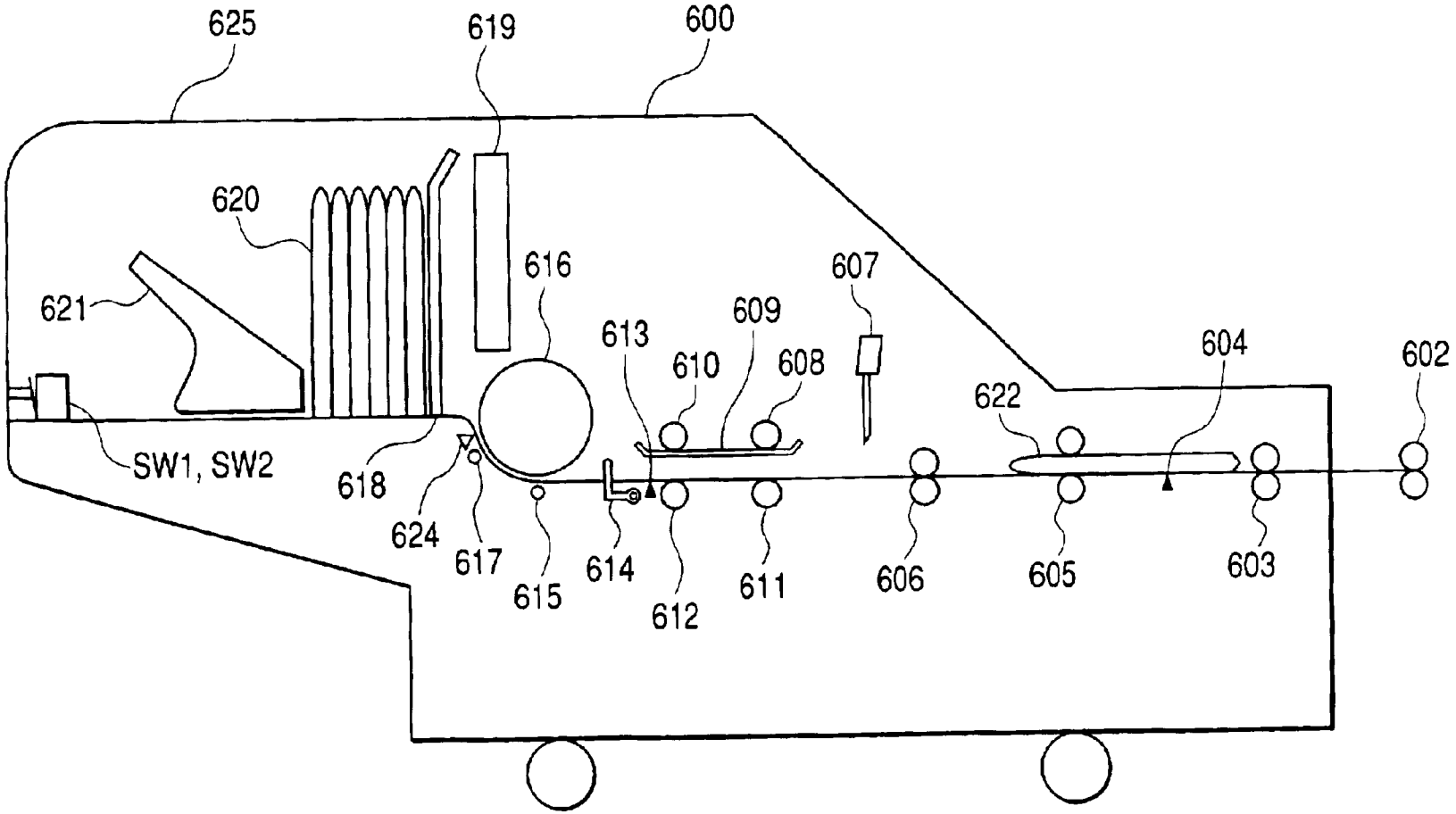
FIG. 4 is a sectional view showing an operation of the trimmer device.
Figure 5:
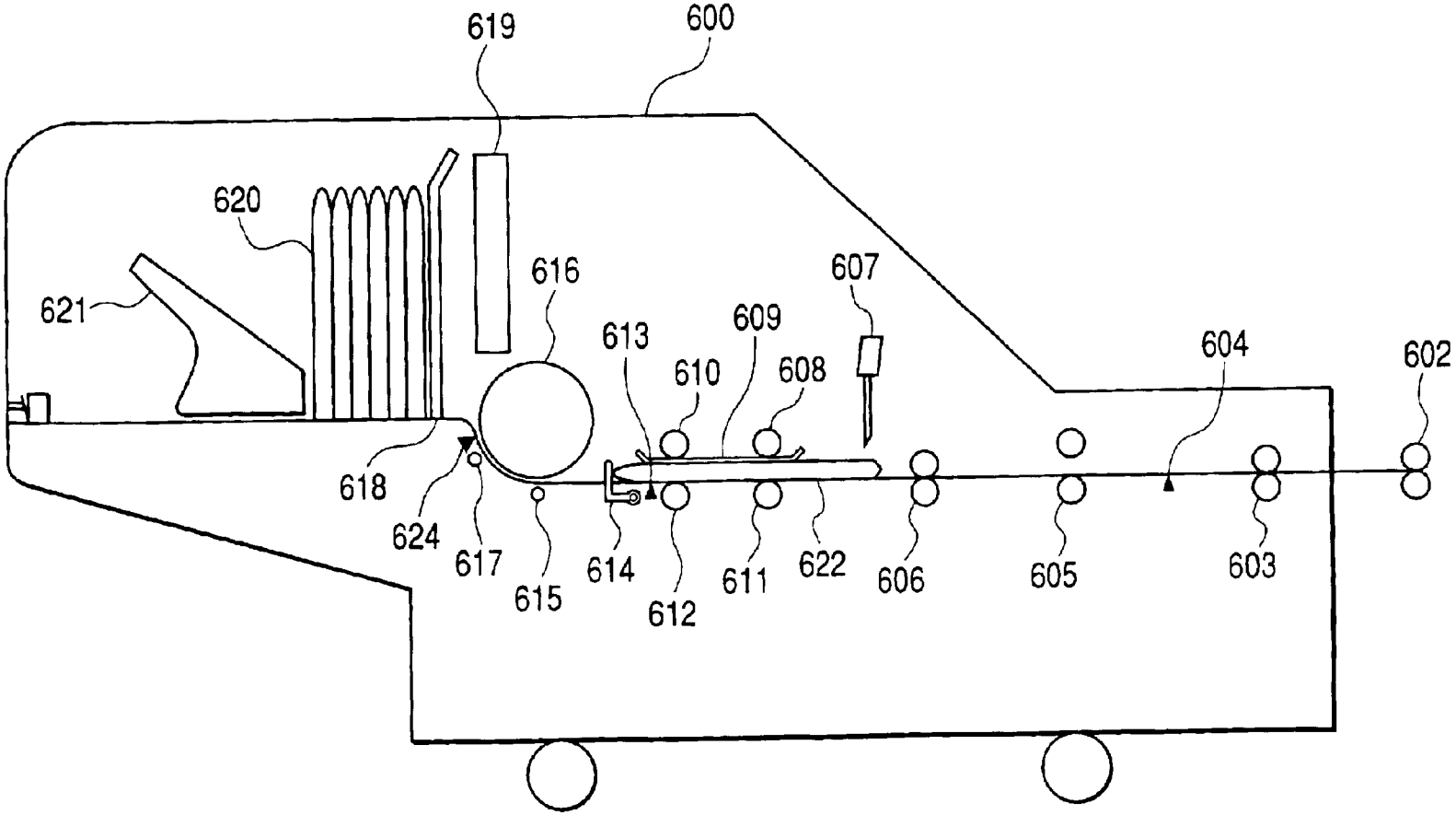
FIG. 5 is a sectional view showing an operation of the trimmer device.

As shown in FIG. 4, if the sheet bundle 622 passes an input sensor 604, the pusher plate 619 is moved back on the right by a pusher motor M27 as the processing operation to discharge the sheet bundle 622. Then, as shown in FIG. 5, to uniformly cut out the trailing edge of the sheet bundle 622 bumped against the stopper 614, a pressing plate 609 is lowered so that the sheet bundle 622 is pressed and fixed by driven rollers 608 and 610 provided on the pressing plate 609.

Figure 6:
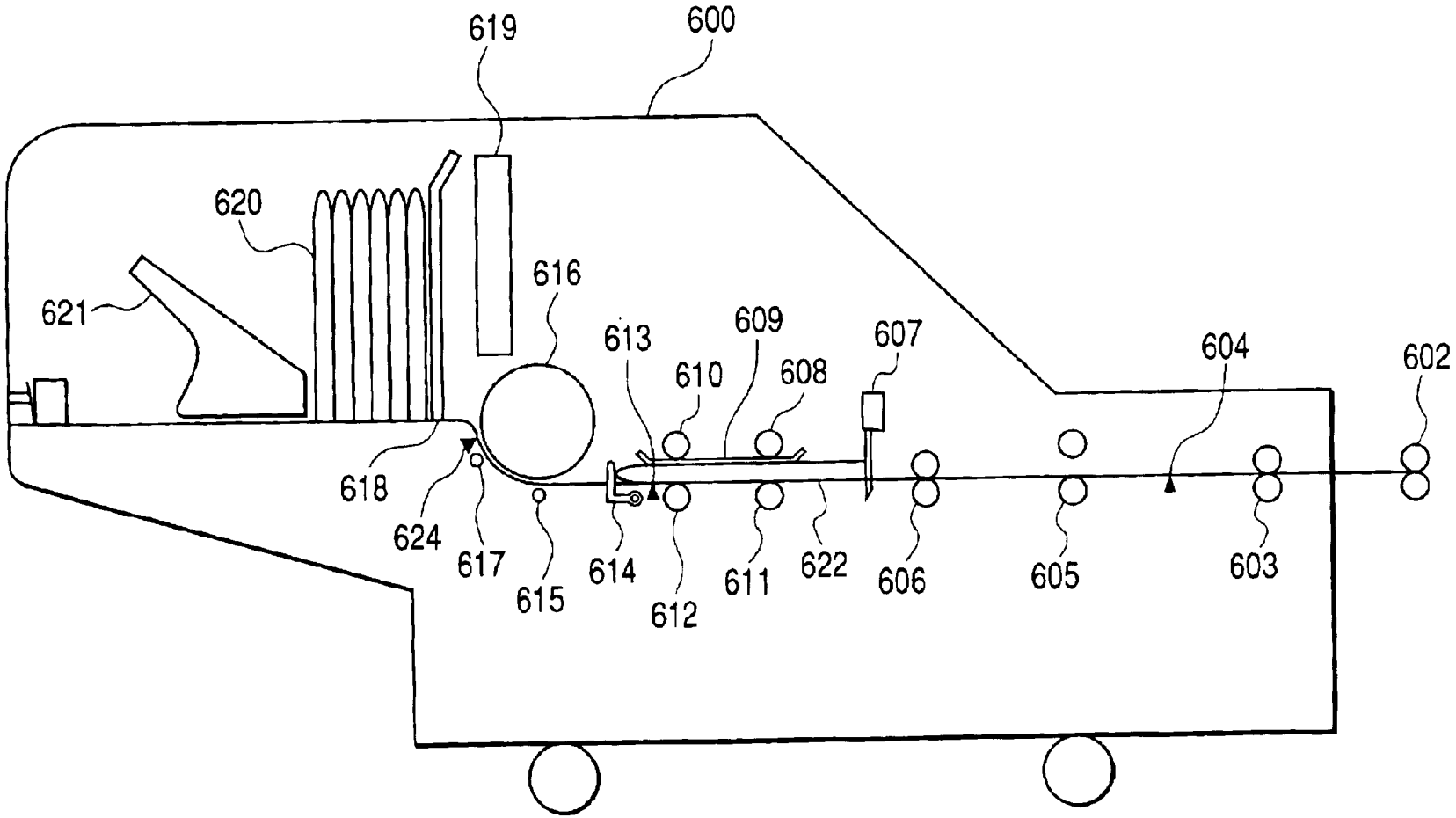
FIG. 6 is a sectional view showing an operation of the trimmer device.
Figure 7:
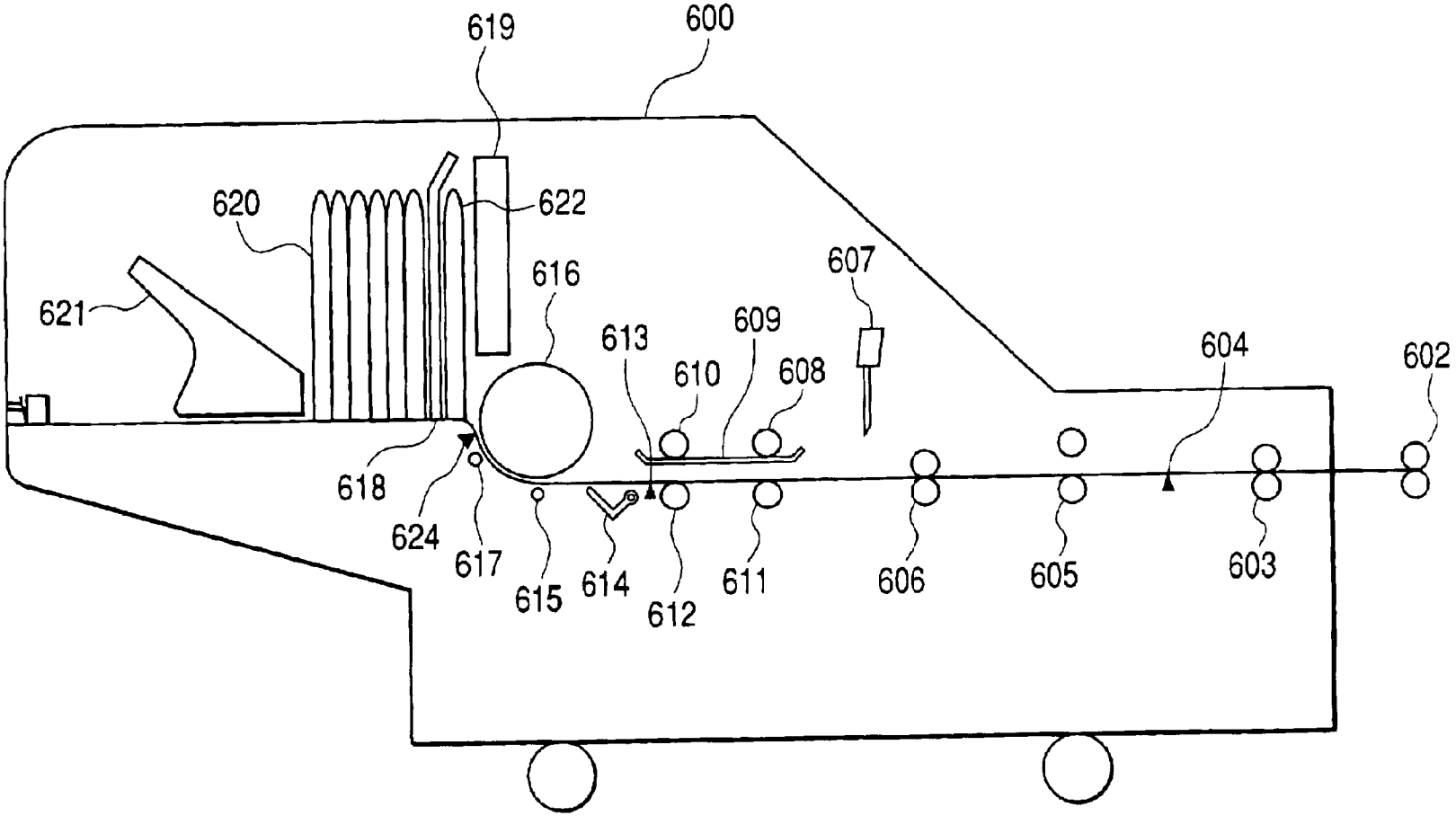
FIG. 7 is a sectional view showing an operation of the trimmer device.

The trailing edge of the pressed sheet bundle 622 is cut out by lowering the cutter 607 as shown in FIG. 6, and after then the cutter 607 is moved back by a not-shown cutter motor M22 as shown in FIG. 7. Moreover, the pressing plate 609 is moved up or raised, and the stopper 614 is moved back on the downside of the conveying path by a not-shown stopper release motor M24.

Figure 8:
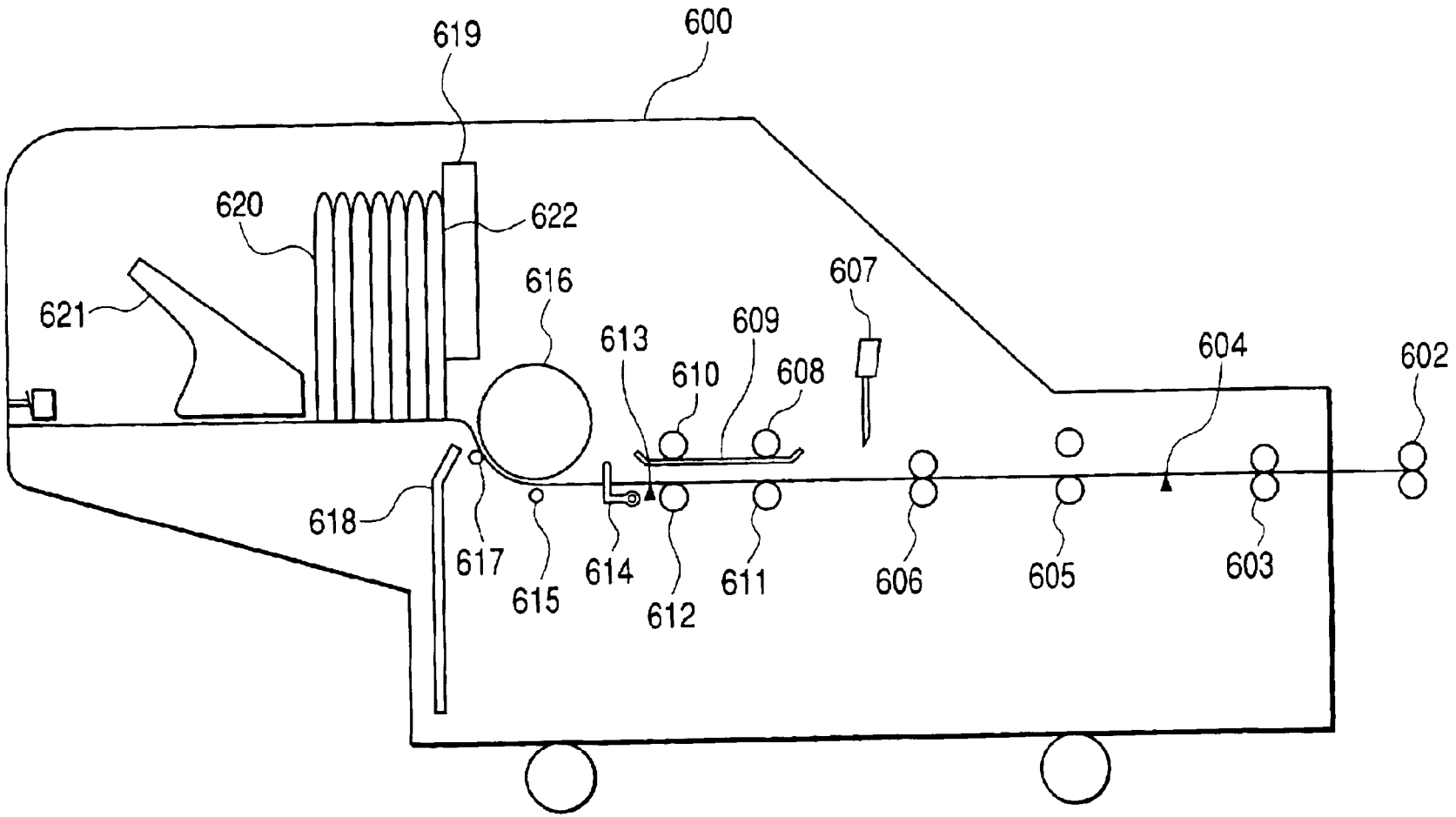
FIG. 8 is a sectional view showing an operation of the trimmer device.
Figure 9:
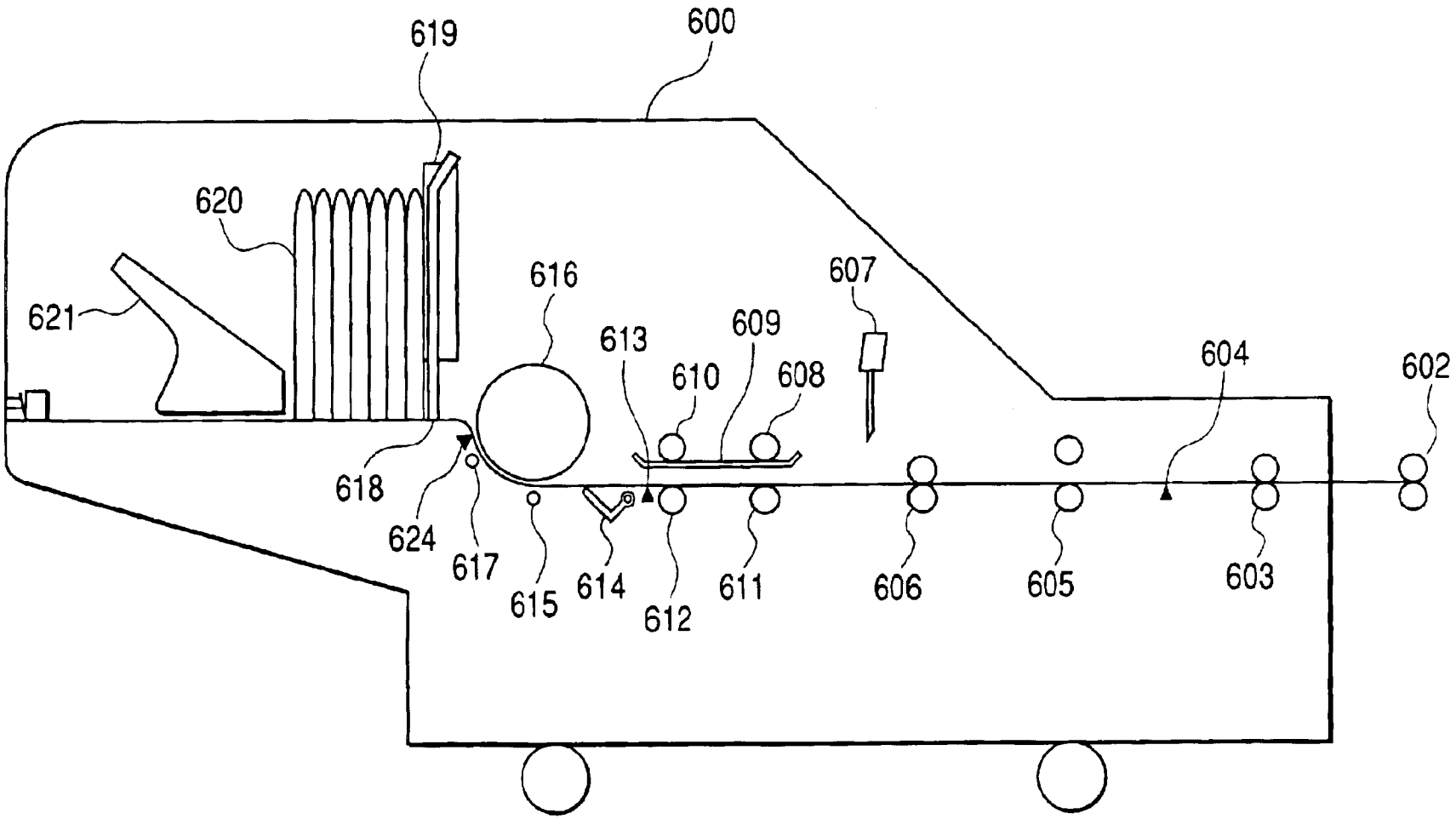
FIG. 9 is a sectional view showing an operation of the trimmer device.

The cut-out sheet bundle 622 is conveyed to the sheet discharge unit by the conveying rollers 611 and 612, and then discharged between a holder plate 618 and the pusher plate 619 by sheet discharge rollers 616, 615 and 617 (FIG. 7). After then, as shown in FIG. 8, the holder plate 618 is lowered by a holder motor M26. Thus, in conjunction with the lowering of the holder plate 619, the pusher plate 619 pushes and discharges the sheet bundle 622 toward the already-stacked sheet bundles 620 by the pusher motor M27. Then, as shown in FIG. 9, the holder plate 618 is moved up, whereby the trimmer 600 comes to be in the standby state again. Although it is not illustrated in detail, the sheet discharge unit covers an area ranging from the point where the conveying of the cut-out sheet bundles starts for the sheet discharge process to the point where the sheet bundles are completely discharged and stored in the stack unit. Here, although the sheet discharge unit is explained as above, the sheet discharge unit is not limited to this.

Also, as shown in FIG. 3, if the stack cover 625 is opened, microswitches SW1 and SW2 are turned off.

Figure 10:
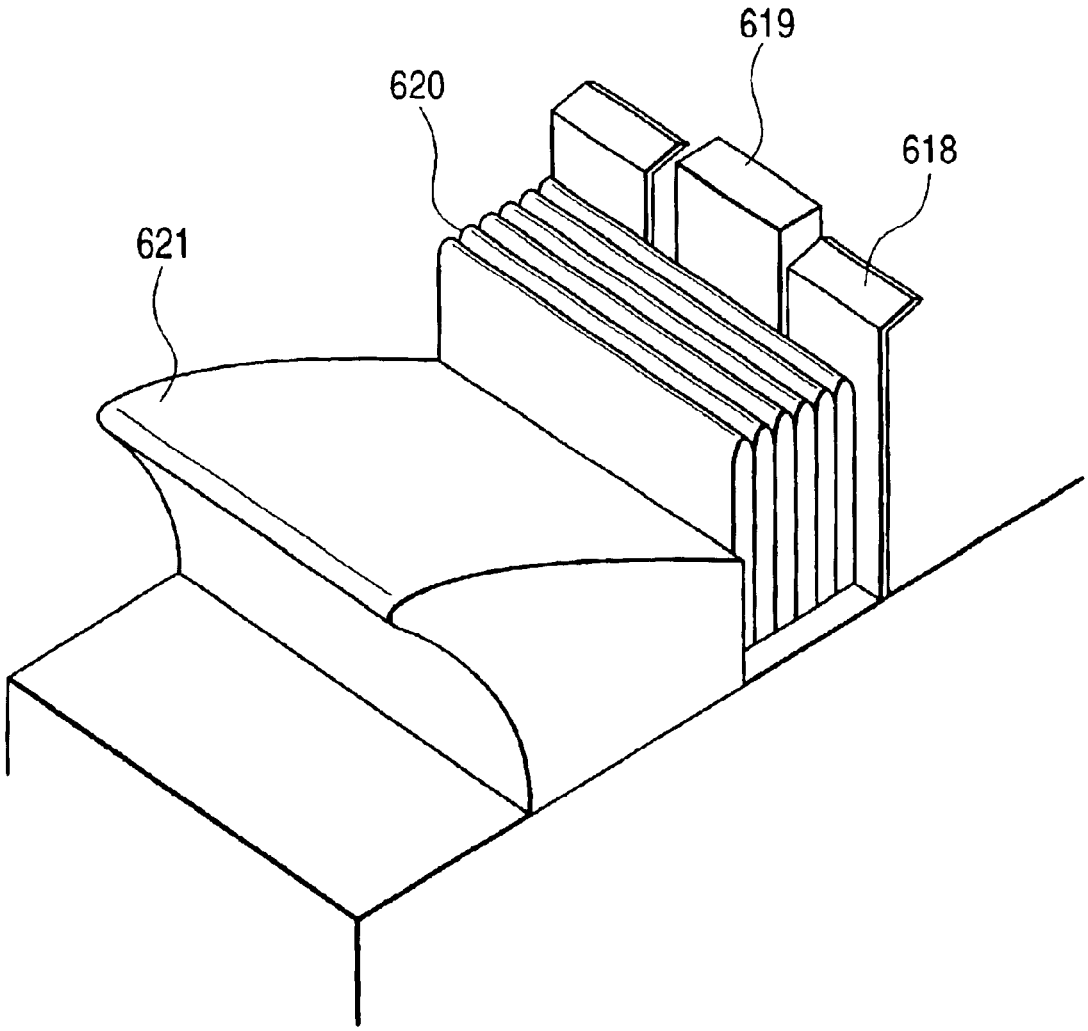
FIG. 10 is a perspective view showing an operation of the trimmer device.
Figure 11:
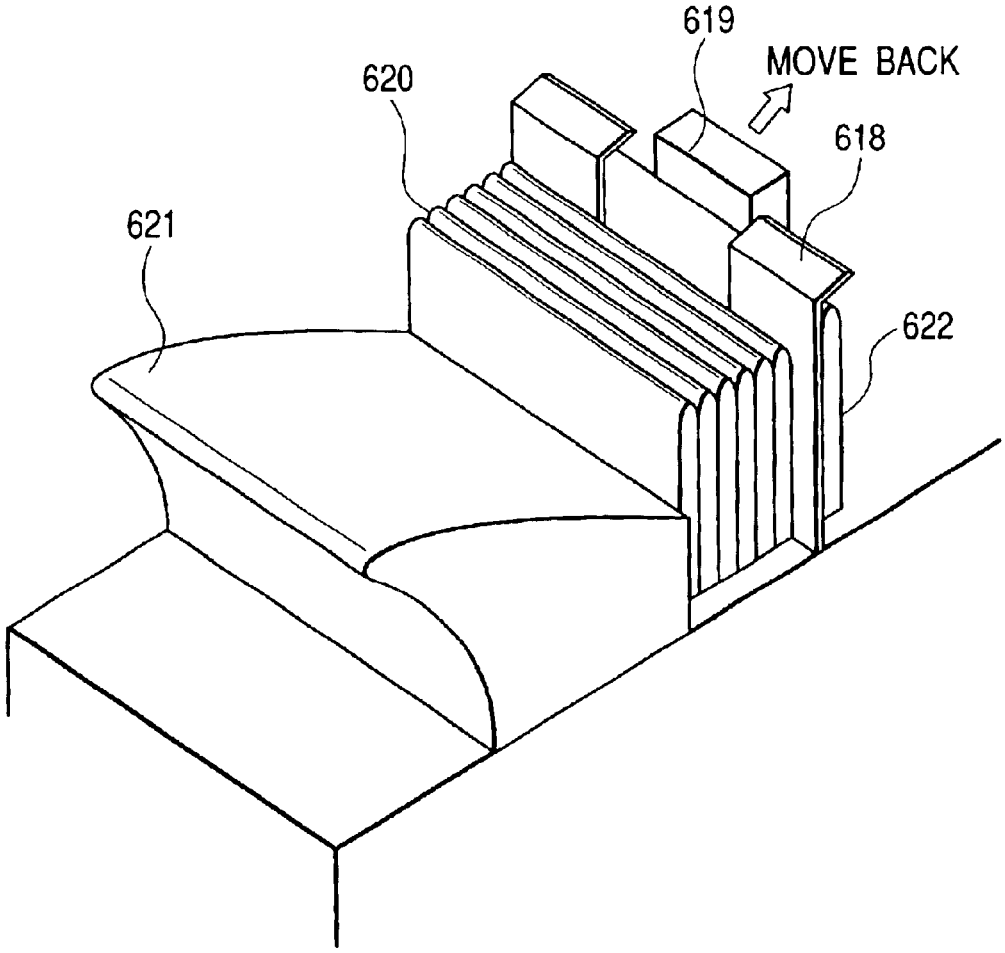
FIG. 11 is a perspective view showing an operation of the trimmer device.
Figure 12:
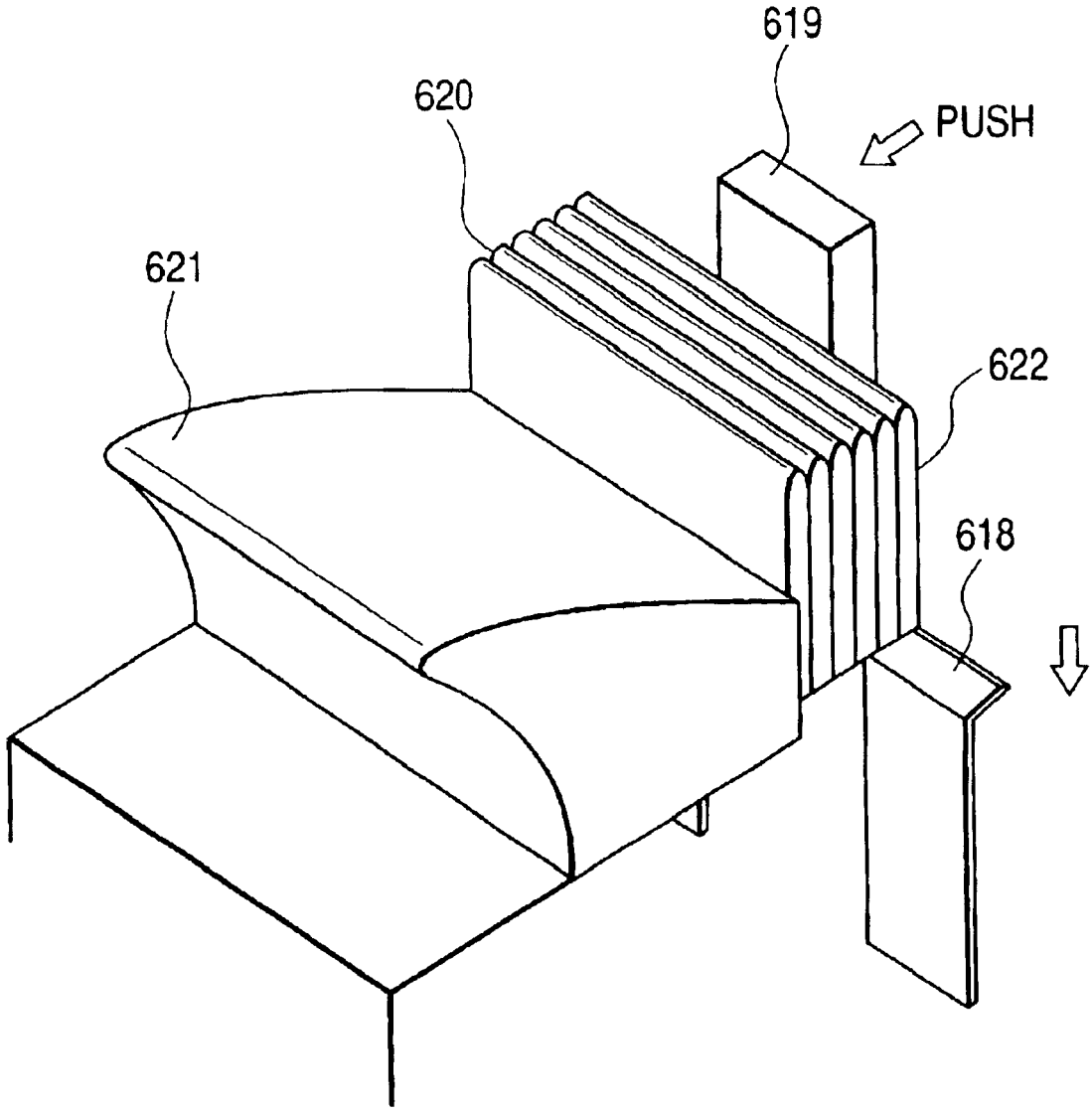
FIG. 12 is a perspective view showing an operation of the trimmer device.

FIGS. 10, 11 and 12 are operation perspective views showing the already-stacked sheet bundles 620, the holder plate 618, the pusher plate 619, the stack tray 621 and the sheet bundle 622 in the sheet discharge process of the trimmer 600 shown in FIGS. 3 to 8. (Here, it is assumed that the discharge rollers of the sheet discharge unit are not shown.)

FIG. 10 is the perspective view before the operation of the trimmer 600 according to the saddle stitch bookbinding starts. If the sheet bundle 622 is conveyed to the trimmer 600 in the state shown in FIG. 10, the pusher plate 619 is moved back on the right by the pusher motor M27 to discharge the sheet bundles 622 to the stack unit, as shown in FIG. 11, whereby the sheet bundles 622 are discharged after they are cut out. After then, as shown in FIG. 12, the holder plate 618 is lowered by the holder motor M26. Moreover, in conjunction with the lowering of the holder plate 619, the pusher plate 619 pushes and aligns the sheet bundle 622 toward the already-stacked sheet bundles 620 by the pusher motor M27.

Explanation of Block Diagram Concerning Finisher Control

Figure 13:
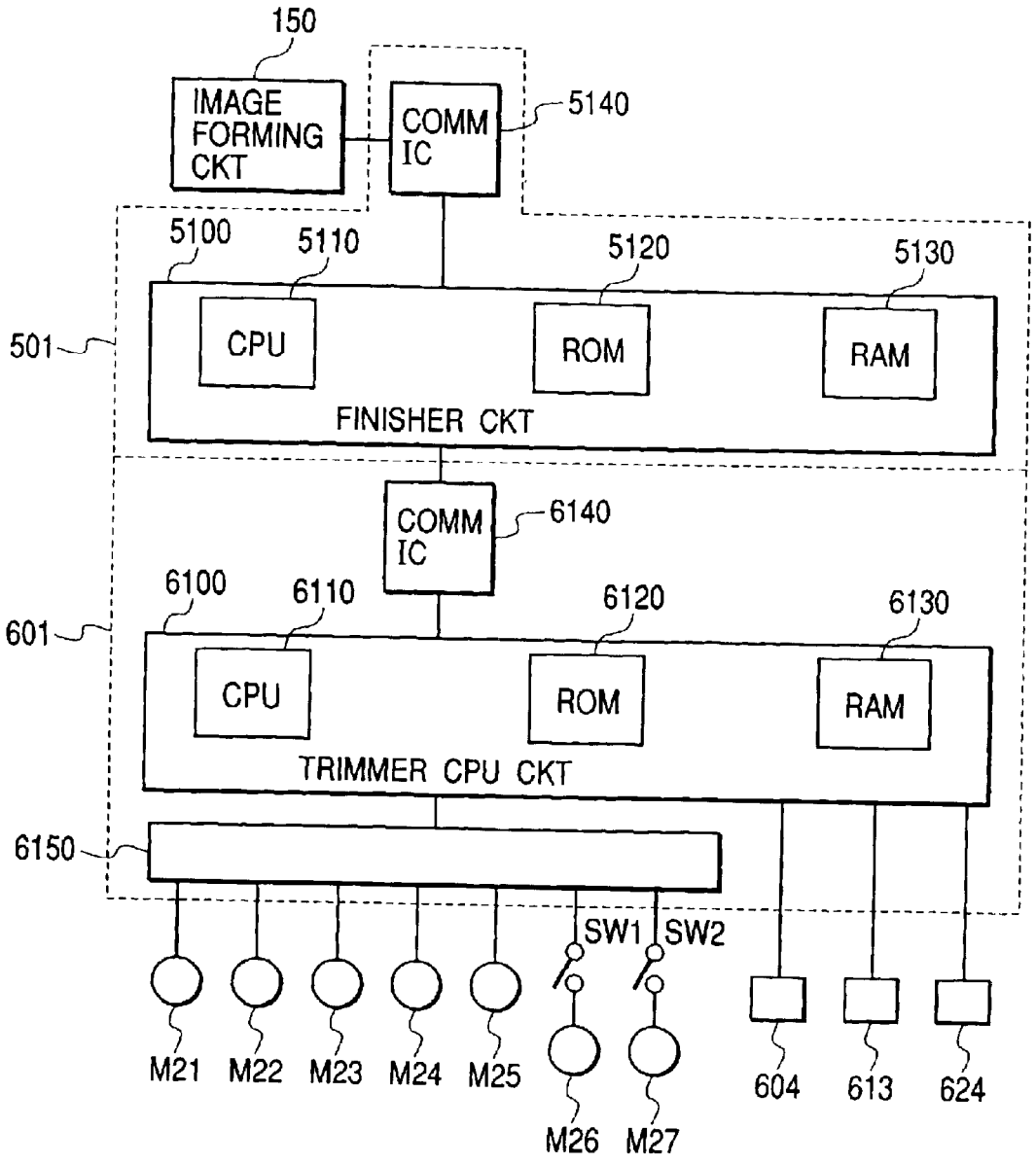
FIG. 13 is a block diagram showing control units of a finisher device and the trimmer device.

FIG. 13 is a block diagram showing the finisher control unit 501 of the finisher 500 and the trimmer control unit 601 of the trimmer 600.

The finisher control unit 501 which includes a finisher CPU circuit unit 5100 composed of a CPU 5110, a ROM 5120, a RAM 5130 and the like exchanges the data by communicating with the image forming circuit unit 150 of the image forming apparatus 1000 through a communication IC 5140. Here, the finisher control unit 501 is controlled by the CPU 5110 in accordance with various programs stored in the ROM 5120.

Moreover, the trimmer control unit 601 which includes a trimmer CPU circuit unit 6100 composed of a CPU 6110, a ROM 6120, a RAM 6130 and the like exchanges the data by communicating the finisher CPU circuit unit 5100 for the finisher 500 through a communication IC 6140. Here, the trimmer control unit 601 is controlled by the CPU 6110 in accordance with various programs stored in the ROM 6120.

Numeral 6150 denotes a driver circuit which includes various drivers, that is, the driver circuit 6150 drives various motors, solenoids and clutches in response to the signals sent from the trimmer CPU circuit unit 6100.

Symbol M21 denotes a conveying motor which acts as the driving source for the input roller 602, the conveying rollers 603, 605, 606, 611 and 612, and the sheet discharge rollers 615, 616 and 617. Symbol M22 denotes the cutter motor which acts as the driving source for the cutter 607, symbol M23 denotes a pressing motor which acts as the driving source for the pressing plate 609, symbol M24 denotes the stopper release motor which acts as the driving source to release the stopper 614, symbol M25 denotes the stopper motor which acts as the driving source to shift the stopper 614, symbol M26 denotes the holder motor which acts as the driving source for the holder plate 618, and symbol M27 denotes the pusher motor which acts as the driving source for the pusher plate 619.

Numeral 604 denotes the input sensor which is mounted in the vicinity of the input portion of the trimmer 600 to control start timing and the like of a trimmer sequence, numeral 613 denotes a stopper sensor which is mounted on the stopper 614 to control brake timing and the like of the sheet bundle, and numeral 624 denotes a sheet discharge sensor which is mounted on the sheet discharge unit to control the sheet discharge operation and the like.

If the stack cover 625 is opened, the microswitches SW1 and SW2 are turned off, whereby the driving circuits of the holder motor M26 and the pusher motor M27 are disconnected. That is, the microswitches SW1 and SW2 are used as the open/close sensor of the stack cover.

Although the microswitches SW1 and SW2 are provided to improve safety when the stack cover is opened and the processed sheets are taken out, an independent open/close sensor may be provided instead of these microswitches. In this case, when it is detected by the open/close sensor that the stack cover is opened, an instruction is transmitted from the CPU 6110 to the driver circuit 6150, whereby the holder motor M26 and the pusher motor M27 are turned off.

Explanation of Operation by Flow Charts

FIGS. 14 to 20 are flow charts showing the trimmer operation by the CPU 6110 according to the present embodiment. It should be noted that the control programs according to these flow charts have been written in the ROM 6120. Hereinafter, the control concerning the operation of the trimmer 600 will be explained in detail with reference to FIGS. 14 to 20.

Figure 14:
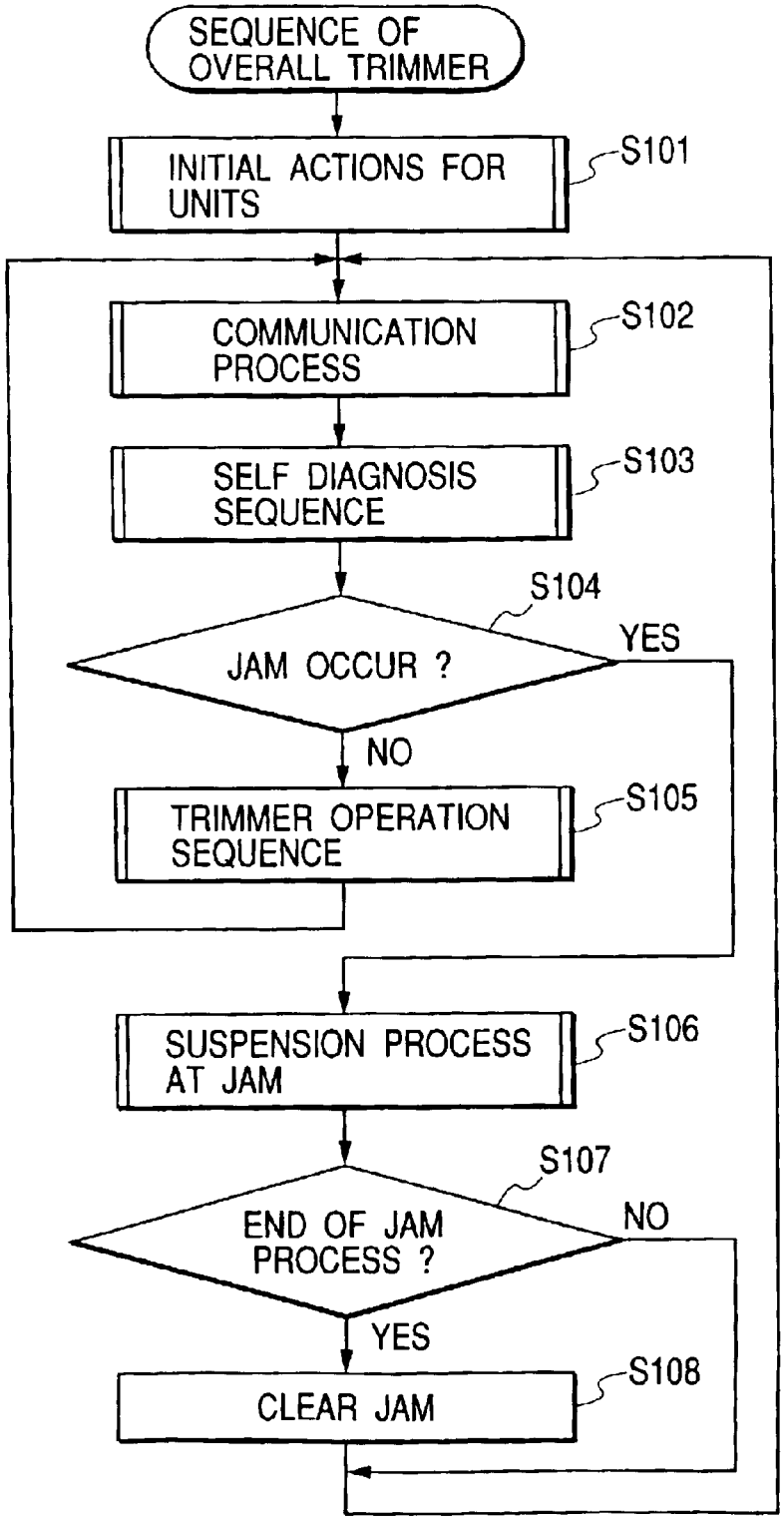
FIG. 14 is a flow chart showing a control sequence of the overall trimmer device.

FIG. 14 is the flow chart showing the overall operation sequence of the trimmer 600.

First, after the power supply of the image forming apparatus 1000 is turned on, an initial action of each driving unit of the trimmer 600 is performed. Here, it should be noted that the initial action is to shift each driving unit of the trimmer 600 to its home position. That is, the cutter 607 and the pressing plate 609 are respectively shifted to the positions not to intercept the conveying of the sheet bundle as shown in FIG. 3, and, similarly the stopper 614 is shifted to the home position (i.e., the position not to intercept the conveying of the sheet bundle) (step S101).

After the initial action is performed by the trimmer 600, a communication process in a step S102, a self diagnosis process in a step S103 and a trimmer operation sequence in a step S105 are sequentially performed. These processes are time-divisionally and continuously performed as parallel processes in the process of the main loop. It should be noted that the parallel processes are performed in multitasking.

The communication process in the step S102 is to exchange the data between the finisher 500 and the main body of the image forming apparatus, or between the trimmer 600 and the finisher 500, and is performed by way of serial communication and the like. In the communication process from the finisher 500 to the trimmer 600, following signals are sent.

That is, the signals include a start signal representing that a job of a saddle stitch folding operation is started with depression of a start key by an operator, a sheet size signal representing the size of the sheet conveyed from the main body of the image forming apparatus to the trimmer 600 through the finisher 500, a number signal representing the number of the sheets of the sheet bundle conveyed to the trimmer 600, a bundle discharge command transmitted at the timing of conveying the last sheet of the sheet bundle into the finisher 500, an end signal representing that the job of the saddle stitch folding operation ends, and the like. Here, it should be noted that the bundle discharge signal may be a signal which is obtained when the sheet bundle discharged from the finisher 500 is detected by a sheet discharge sensor (not shown). In any case, the trimmer operation is performed according to these signals.

Next, in the step S103, the self diagnosis process is performed for the trimmer 600, that is, it is checked in the self diagnosis sequence whether the stack cover 625 is opened or closed. Moreover, in the case where the stack cover 625 is opened, a status flag which represents the states of the sheet bundle conveyed to the trimmer 600 or the sheet bundle conveyed within the trimmer 600 is checked. In the self diagnosis sequence, if the stack cover 625 is opened while the trimmer 600 is discharging the sheet bundle to the stack unit, the image forming apparatus 1000 including the trimmer 600 is set to be in the jam state. This operation will be explained in detail with reference to FIG. 20.

Before the trimmer operation sequence is executed in the step S105, it is judged in a step S104 whether or not a jam occurs in the trimmer 600. If the jam occurs in the trimmer 600, the flow advances to a step S106 to stop each driving unit as a process in abnormal circumstances of the jam. Then, the jam state is not cleared until the jam process of the trimmer 600 ends (step S107). After the jam process ends, the jam state is cleared in a step S108, and the state is changed to the ordinary standby state. At this time, if all the covers including the stack cover of the trimmer 600 are closed after the jam process, the same initial action as that in the step S101 is performed.

On the other hand, if the jam is not detected in the step S104, the flow advances to the step S105 to execute the trimmer operation sequence. In the trimmer operation sequence, the sheet bundle conveyed from the upstream side is accepted, and there are performed such controls as a cutting process, a stacking process and the like to the accepted sheet bundle.

Figure 15:
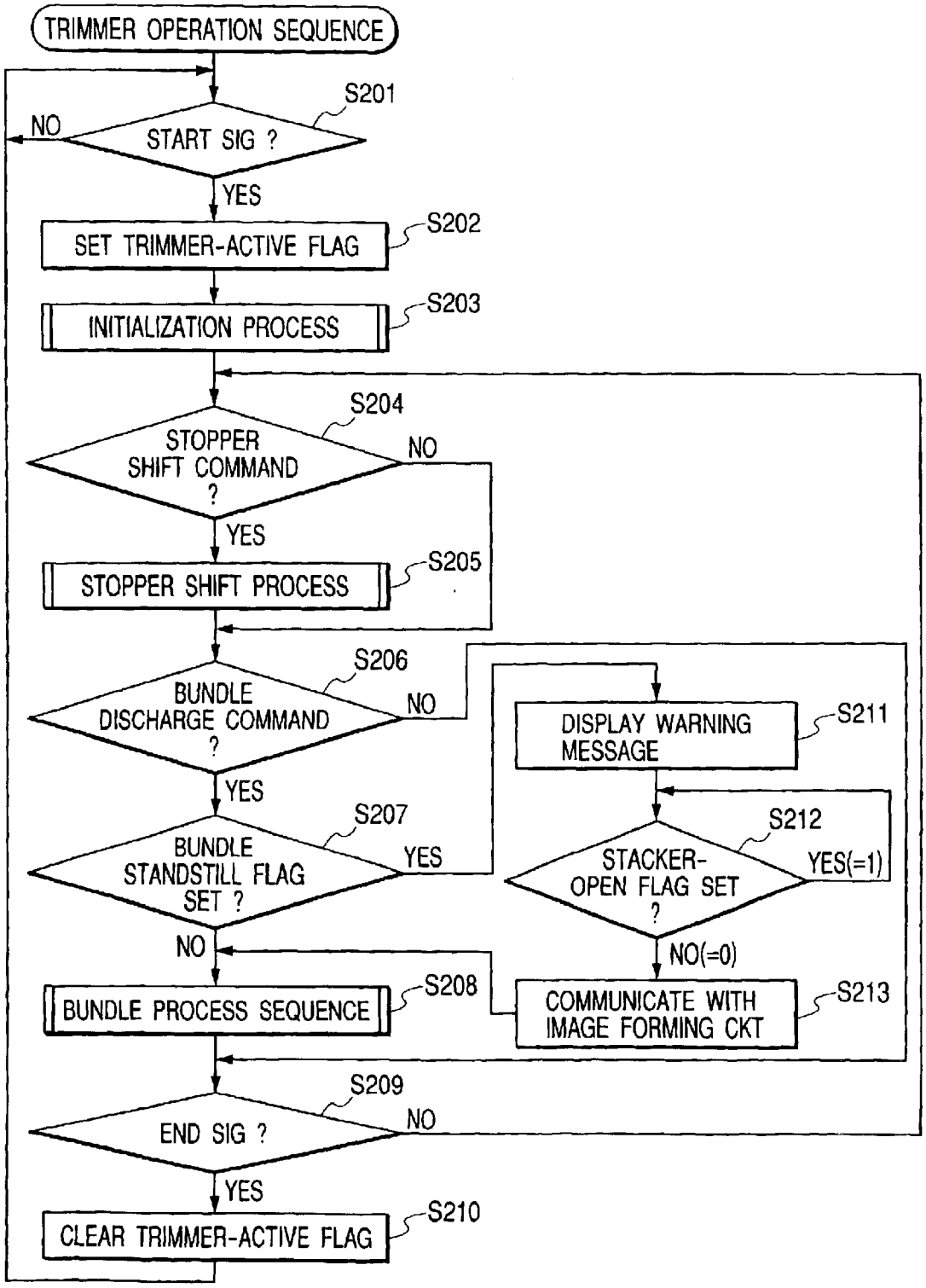
FIG. 15 is a flow chart showing an operation sequence of the trimmer device.

Next, the trimmer operation sequence to be executed in the step S105 of FIG. 14 will be explained in detail with reference to the flow chart shown in FIG. 15.

In a step S201, it is judged whether or not a "start signal" representing the operation start is sent from the upstream-side device such as the finisher 500 or the like from which the sheet bundle is conveyed. Here, it should be noted that the "start signal" is generated when the start key for performing the job of the saddle stitch folding operation is depressed by the operator or when the job of the saddle stitch folding operation is started by the operator through the printer driver of a PC (personal computer). The trimmer 600 is in a start signal waiting state until the "start signal" is received in the step S201.

If the "start signal" is set in the step S201, the trimmer 600 operates, whereby an internal flag called a "trimmer-active flag" representing the operation start is set (step S202). Then, each driving unit of the trimmer 600 is initialized for the operation start as circumstances demand (step S203).

In order to stop the sheet bundle by making it contact with the stopper 614, it is necessary to shift the stopper 614 to the position according to the size of the sheet bundle. Thus, it is judged in a step S204 whether or not a stopper shift command for the operation of the stopper 614 is sent from the finisher 500 or the control unit in the main body of the image forming apparatus. Here, it should be noted that the stopper shift command includes the sheet size data, the data representing the number of sheet bundles, and the like. If the stopper shift command is sent in the step S204, a stopper shift process is performed in a step S205. Here, it should be noted that the stopper shift process is the process to shift the stopper 614 to the position calculated based on the data of the sheet bundle, and is determined based on the sheet size, the number of the sheets of the sheet bundle, and the like.

Next, it is judged in a step S206 whether or not the "bundle discharge command" is received from the upstream-side device such as the finisher 500 or the like. The "bundle discharge command" is the signal representing that the sheet bundle is conveyed from the upstream-side device such as the finisher 500 or the like, and, after this signal (command) is issued, the sheet bundle is actually conveyed from the finisher 500. At the time when the last sheet of the sheet bundle is conveyed to the finisher 500 and detected by the sensor in the finisher 500, the "bundle discharge command" is sent from the CPU 5110 of the finisher 500 to the CPU 6110 of the trimmer 600. Here, the "bundle discharge command" may be the command which is issued based on the signal obtained when the sheet bundle discharged from the finisher 500 is detected by a sheet discharge sensor (not shown).

Then, it is judged whether or not the "bundle discharge command" is issued (step S206). If the "bundle discharge command" is issued and a "bundle standstill flag" is set (step S207), the trimmer 600 is set to be in the jam state (i.e., the state that the trimmer operation is standstill or stopped) (step S211).

At this time, the finisher 500 is stopped in the state that the sheet bundle in the finisher 500 is stored at one location on the holding guide 820 so as not to be mixed with the succeeding sheet bundle. Then, a warning message is displayed on the operation unit, and the flag representing that the sheet bundle is standstill in the trimmer 600 is set and it is communicated to the main body of the image forming apparatus through the finisher 500 (step S211).

The displayed warning message indicates that the stack cover is retained to be open. In this case, it is preferable to display a message such as "The apparatus is standstill now, please close the stack cover".

While the sheet bundle is standstill according to the "bundle standstill flag" within the trimmer 600 and the saddle stitch bookbinding job is on the way, the image forming operation of the main body of the image forming apparatus is surely stopped at an arbitrary certain break (a point between arbitrary jobs). Then, the recording sheets are discharged to the finisher 500 such that the recording sheets do not remain in the main body of the image forming apparatus and the abnormal state such as the jam does not occur. Incidentally, the operation of the image forming apparatus will be described later with reference to FIG. 21.

Then, the trimmer 600, the finisher 500 and the main body of the image forming apparatus are standstill until the stack cover 625 is closed (step S212). In the case where the stack cover 625 is closed, if the saddle stitch bookbinding job is on the way, a "stacker open flag" representing the state that the stack cover 625 is opened is reset and it is communicated to the image forming apparatus through the finisher 500 so as to resume the image forming operation (step S213). Then, the trimmer 600 comes to be in a bundle process sequence, and also the main body of the image forming apparatus resumes the image forming operation.

Figure 18:
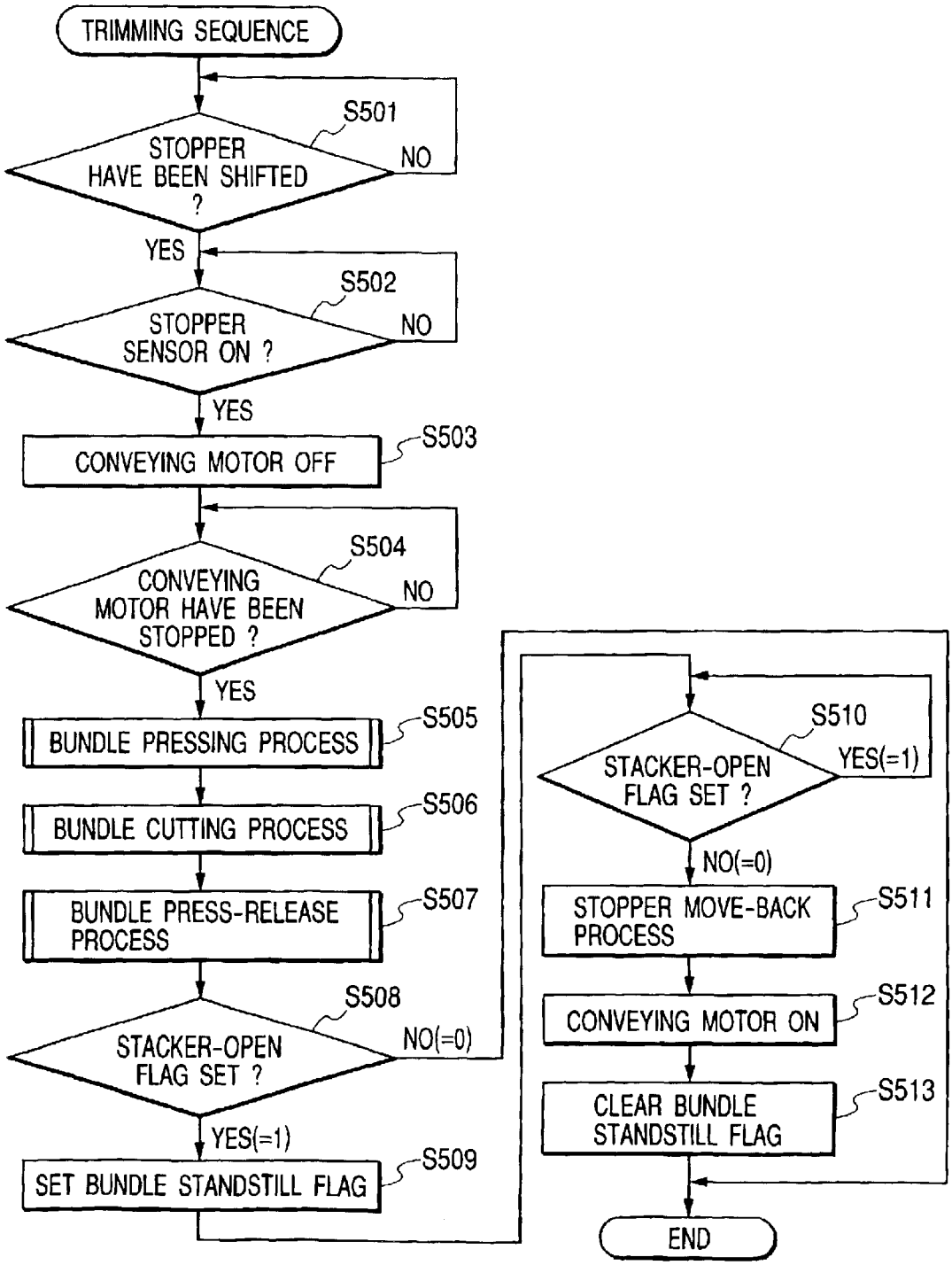
FIG. 18 is a flow chart showing a trimming sequence.

The "bundle standstill flag" is the flag representing that the sheet bundle precedently conveyed to the trimmer 600 is standstill at a predetermined position on the conveying path of the trimmer 600 before the discharging of the sheet bundle to the stack tray 621 ends. The "bundle standstill flag" is set while the later-described bundle process sequence shown in FIG. 18 is being executed.

During the discharge operation of the sheet bundle, if the user opens the stack cover 625 to be opened or closed when the user takes out the sheet bundle, the driving of the sheet discharge unit is disconnected and thus the sheet bundle can not be discharged, whereby the sheet bundle precedently conveyed on the conveying path of the trimmer 600 is controlled to be stopped.

In the step S207, if it is judged whether or not the "bundle standstill flag" is set, and if the "bundle discharge command" is issued for the succeeding sheet bundle, there is a fear that the sheet bundle standstill on the conveying path of the trimmer 600 collides against the succeeding sheet bundle in the finisher 500. Therefore, the apparatus is stopped as the jam state (i.e., the state that the trimmer operation is standstill).

It is possible to stop the operations of the finisher 500 and the trimmer 600 before the succeeding sheet bundle collides against the precedent sheet bundle (i.e., the standstill sheet bundle), whereby it is possible to obviate the collision of the sheet bundles and also prevent a complicated jam reset process after the collision of the sheet bundles.

On the other hand, if the "bundle standstill flag" is not set in the step S207, the ordinary bundle process sequence is executed (step S208). The bundle process sequence in this case will be explained in detail with reference to FIG. 16.

After the bundle process sequence ends, it is judged in a step S209 whether or not the overall job of the saddle stitch folding operation ends. This judgment is performed based on the reception of an "end signal" representing that the overall job of the saddle stitch folding operation ends. Therefore, the process in the steps S204 to S209 is repeated until the "end signal" is received.

Since the detection of the "end signal" indicates that the end of the operation by the trimmer 600, the "trimmer-active flag" is cleared (step S210), and the flow returns to the step S201.

Figure 21:
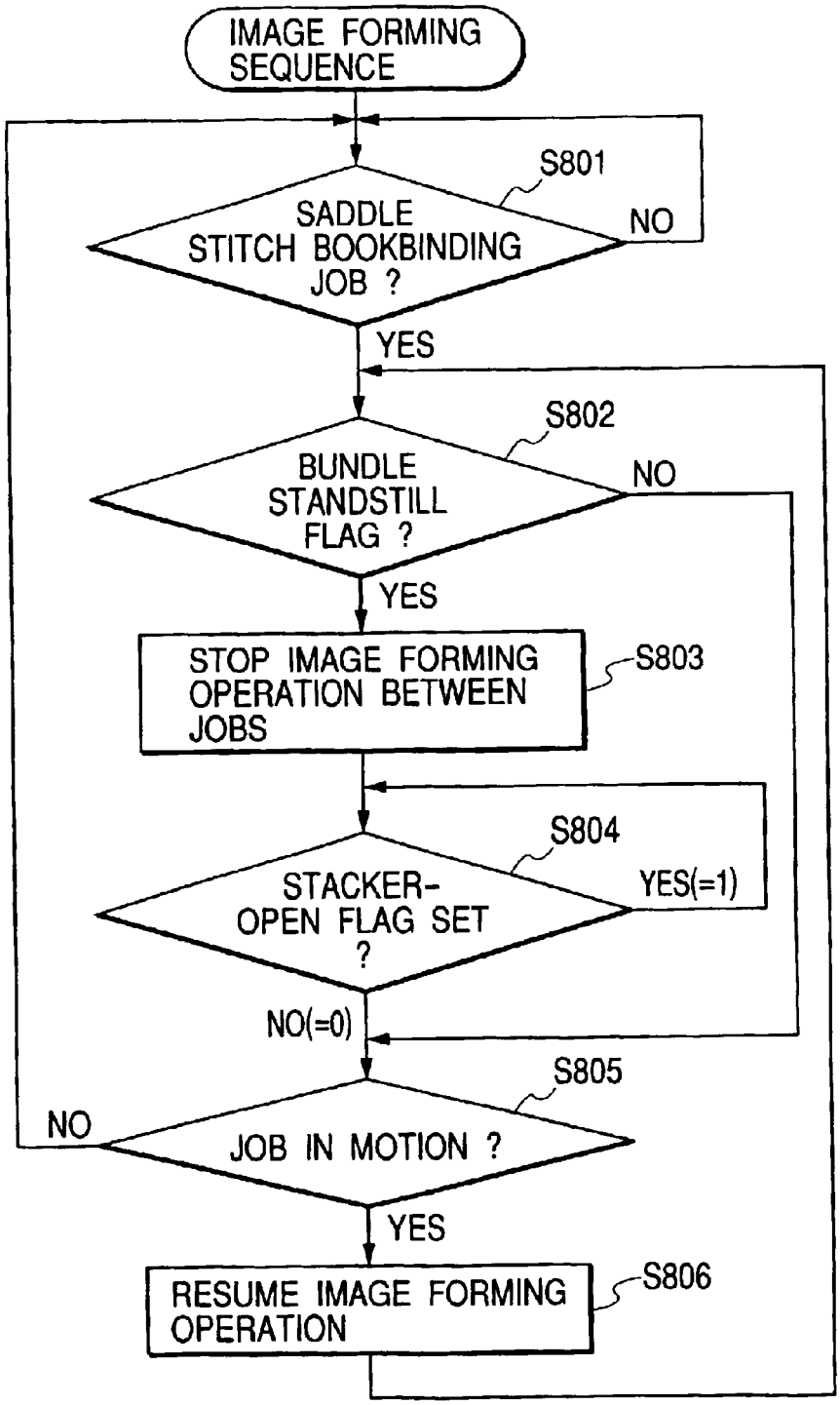
FIG. 21 is a flow chart showing an image forming sequence.

Next, the image forming sequence of the main body of the image forming apparatus in a case where the stack cover 625 is opened when executing the saddle stitch bookbinding job will be explained with reference to the flow chart shown in FIG. 21. Here, it should be noted that the control programs according to the flow chart have been written in the ROM 151 and are then executed by the CPU 153.

First, it is judged whether or not the on-execution job set by the user is the saddle stitch bookbinding job (step S801). If the on-execution job is the saddle stitch bookbinding job, then it is further judged whether or not the "bundle standstill flag" representing whether or not the sheet bundle is standstill in the trimmer 600 is set (step S802). If the sheet bundle is standstill, the image forming operation of the main body of the image forming apparatus is stopped at the break between the jobs (step S803). Although it is not much of a problem to stop the image forming operation between the arbitrary jobs, the image forming operation is preferably stopped between the jobs immediately after the operation of the trimmer 600 is stopped.

Then, the image forming operation is standstill until the stack cover 625 is closed, that is, until the state represented by the "stacker open flag" is changed from the "open" state to the "close" state by communicating with the trimmer 600 (step S804). However, if the state of the "stacker open flag" is changed from the "open" state to the "close" state before the image forming operation is stopped in the step S803, the image forming operation can be continued without stopping the image forming operation.

Then, if the stack cover 625 is closed and the saddle stitch bookbinding job is on the way (step S805), the image forming operation is resumed (step S806). On the other hand, if the saddle stitch bookbinding job has ended when the stack cover 625 is closed, the process returns to the step S801.

In this way, if the stack cover 625 is opened and the sheet bundle is standstill in the trimmer 600, the main body of the image forming apparatus is stopped at the break between the jobs, whereby the sheet bundle can be made standstill at one position without mixing the different sheet bundles in the finisher 500. Moreover, since the sheets are separately handled for each job, the sheets need not be stopped within the main body of the image forming apparatus, the sheet conveying control can be performed so as to maintain consistency of the sheet bundles, and the complicated sheet conveying control to start conveying the sheets after retaining the sheets at the plural positions can be reduced.

Figure 16:
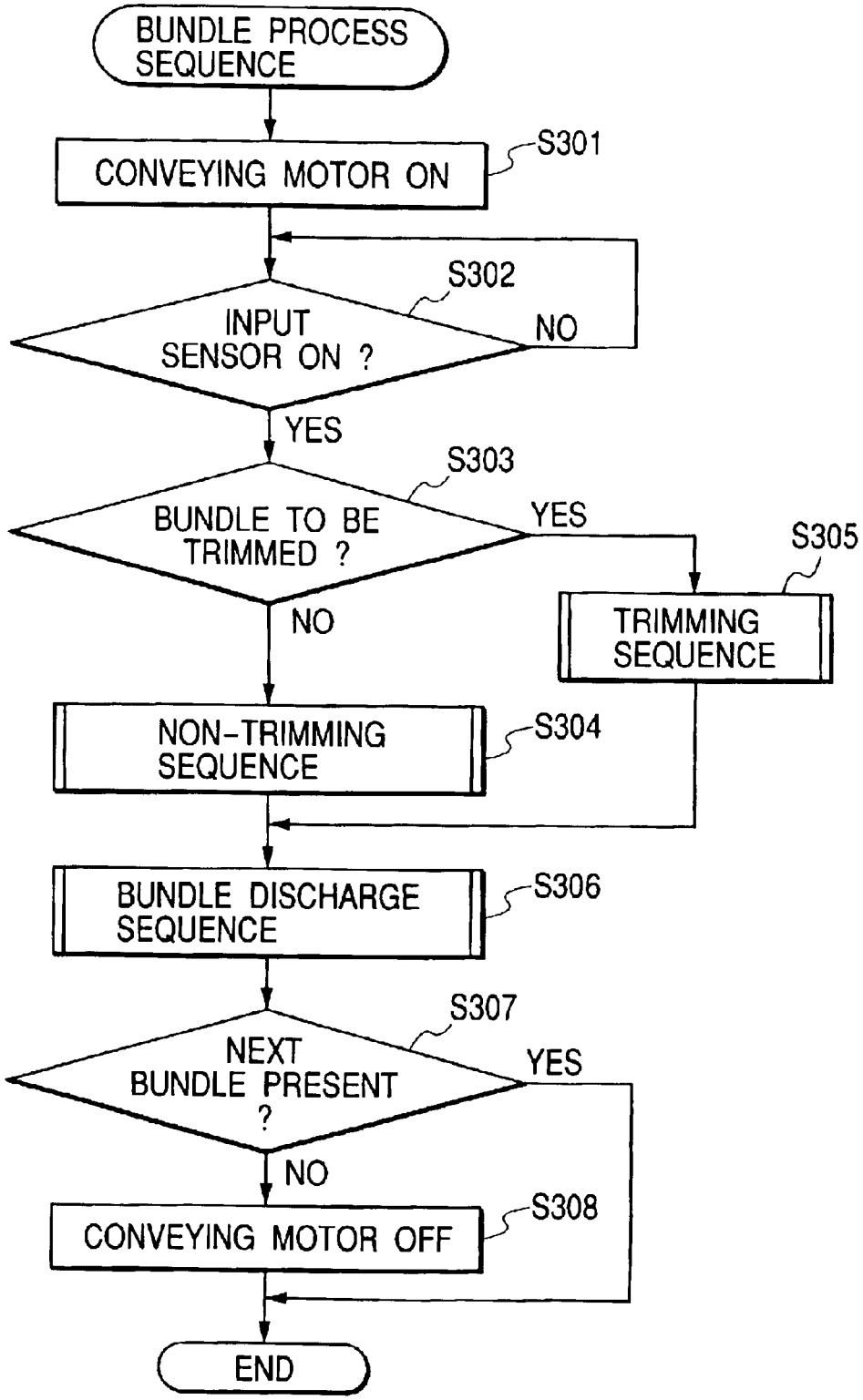
FIG. 16 is a flow chart showing a bundle process sequence.

Next, the bundle process sequence will be explained with reference to the flow chart shown in FIG. 16.

It should be noted that the bundle process sequence is the sequence to perform a trimming process such as cutting and the like to the sheet bundle conveyed from the finisher 500 to the trimmer 600 and then discharge the processed sheet bundle to the stack unit.

The conveying motor is driven to convey the sheet bundle to the trimmer 600 in a step S301, and it is judged in a step S302 whether or not the input sensor 604 is turned on by the conveyed sheet bundle. After the input sensor 604 is turned on, it is further judged whether or not the conveyed sheet bundle is the sheet bundle to be trimming processed (step S303). Here, the sheet bundle to be trimming processed is the sheet bundle of which its edge is cut out and aligned by actually cutting the unfolded side of this bundle. Conversely, the sheet bundle to be not trimming processed is the sheet bundle which is discharged as it is without any cut-out process.

If judged in the step S303 that the conveyed sheet bundle is the sheet bundle to be not trimming processed, the flow advances to a step S304 to execute a non-trimming sequence, while if judged that the conveyed sheet bundle is the sheet bundle to be trimming processed, the flow advances to a step S305 to execute a trimming sequence. In both the sequences, after the corresponding processes end, the flow further advances to a step S306 to execute a (trimmed) bundle discharge sequence. Then, it is judged in a step S307 whether or not there is the sheet bundle to be conveyed next, and the conveying motor is stopped if there is no succeeding sheet bundle (step S308). After then, the bundle discharge sequence ends.

By executing the bundle discharge sequence, either the sheet bundle to be trimming processed or the sheet bundle to be not trimming processed is conveyed on the conveying path and then discharged on the stack tray (stack unit) 621.

Figure 17:
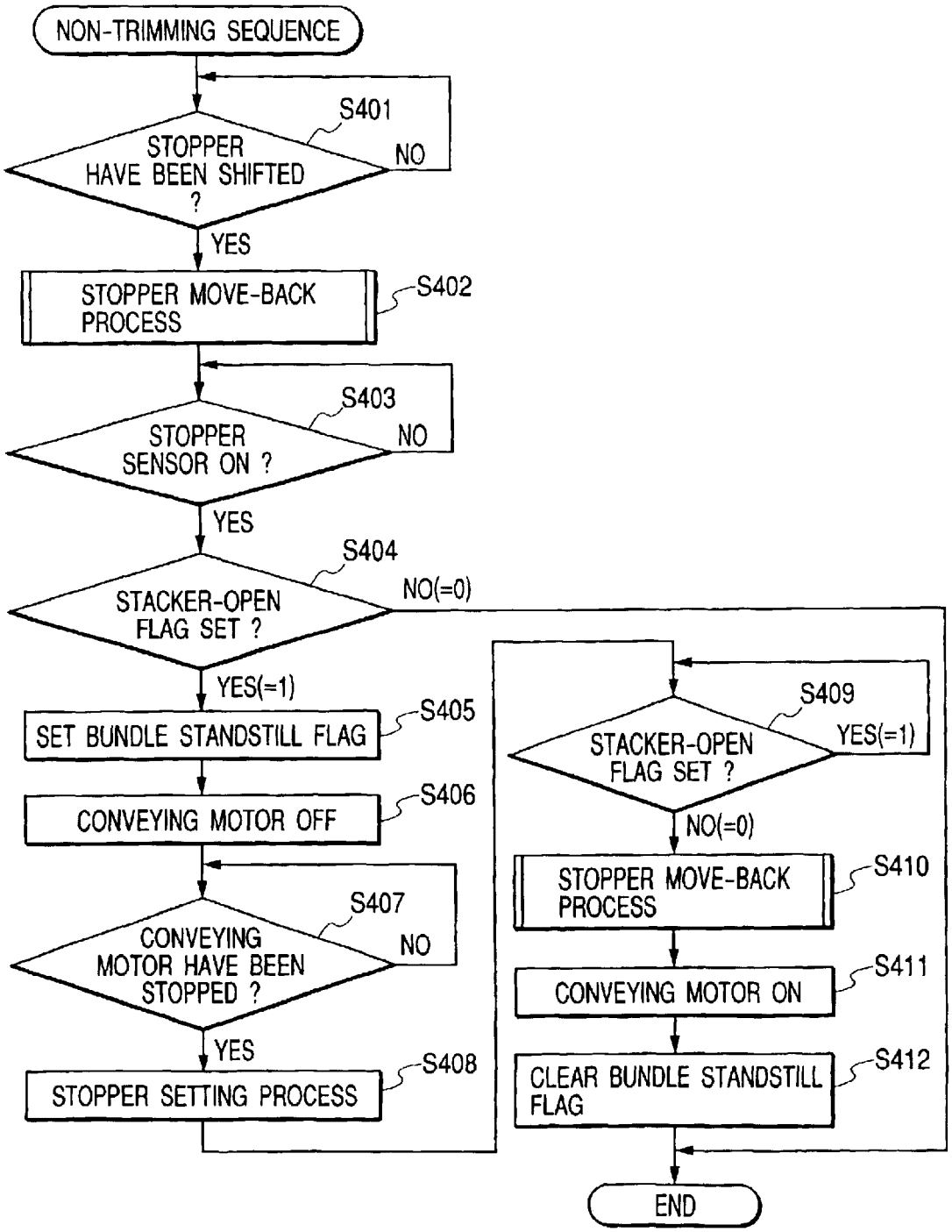
FIG. 17 is a flow chart showing a non-trimming sequence.

Next, the non-trimming sequence in the step S304 of FIG. 16 will be explained with reference to the flow chart shown in FIG. 17.

First, it is confirmed in a step S401 whether or not the stopper 614 has been shifted based on the sheet size of the sheet bungle. The fact that the stopper 614 is in a correct distance (position) is very important not only in the trimming process but also in a jam detection process to judge whether or not the sheet bundle is correctly conveyed, because the stopper sensor 613 is simultaneously shifted together with the stopper 614. Here, the stopper sensor 613 is the sensor which is necessary in the process to be performed when the stack cover 625 is opened, and the detailed operation of the stopper sensor 613 will be explained later. After the stopper 614 has been shifted, a process to move back the stopper 614 is performed (step S402), because, in the non-trimming sequence, it is unnecessary to stop the sheet bundle by bumping it against the stopper 614 and then perform the trimming process.

Then, it is confirmed whether or not the stopper sensor 613 disposed at the position of the stopper 614 is turned on (step S403), and the "stacker open flag" is then checked to confirm whether or not the stack cover 625 is in the open state. Here, the "stacker open flag" is the flag representing the open or close state of the stack cover 625 of the stack unit, and the stack cover 625 is opened if this flag is set to 1, and is closed if this flag is set to 0. In the case where the stack cover 625 is closed, the succeeding process is skipped, and the non-trimming sequence ends. Ordinarily, in the case where the stack cover 625 for taking out the sheet bundle is closed, the above process is performed.

On the other hand, if the "stacker open flag" is set to be 1 in the step S404, that is, if the stack cover 625 is opened, the "bundle standstill flag" is set (step S405). Then, the conveying motor is stopped based on the "bundle standstill flag" being set (steps S406 and S407). Here, the setting of the "bundle standstill flag" represents that the sheet bundle being conveyed is temporarily made standstill in the conveying path by the opening of the stack cover 625.

In a step S408, a stopper setting process is performed so that the stopper 614 is returned from its moved-back position to the position proper as the stopper 614. After then, in a step S409, it waits for the stack cover 625 to be closed, and, if the stack cover 625 is closed, the stopper 614 is moved back so as to continue the conveying operation (step S410). Moreover, the conveying motor is driven (step S411), and the set "bundle standstill flag" is cleared (step S412).

Next, the trimming sequence in the step S305 of FIG. 16 will be explained with reference to the flow chart shown in FIG. 18. Here, the trimming sequence indicates the trimming process to cut out and align the edge of the sheet bundle.

First, it is judged in a step S501 whether or not the stopper 614 has been shifted, and it is then confirmed whether or not the stopper sensor 613 in the vicinity of the stopper 614 is turned on (step S502). Subsequently, the conveying motor is stopped based on that the stopper sensor 613 being turned on (steps S503 and S504), whereby the sheet bundle is stopped and processed at the position of the stopper sensor 613, that is, the sheet bundle is stopped at the position where the edge of the bundle is cut out. Next, a "sheet bundle pressing process" to press the sheet bundle from the top by lowering the pressing plate 609 is performed, whereby the sheet bundle is fixed (step S505). After then, a "sheet bundle cutting process" to cut out the edge of the sheet bundle is performed (step S506), and a "sheet bundle press-release process" is performed by moving up the pressing plate 609 so as to again convey the sheet bundle (step S507).

After then, it is confirmed in a step S508 whether or not "stacker open flag" is set. The "stacker open flag" is confirmed after the pressing of the sheet bundle is released in the step S507, whereby the sheet bundle conveyed from the finisher 500 into the trimmer 600 is conveyed to a predetermined position on the conveying path and then temporarily stopped even if the stack cover 625 is opened. Here, the predetermined position is the position where the trimming process is performed to the sheet bundle conveyed from the finisher 500 to the trimmer 600. Even if the stack cover 625 is opened, the sheet bundle conveyed into the trimmer 600 is surely conveyed to the position of the trimming process, whereby a recovery operation after the stack cover 625 is closed can be promptly performed.

If it is confirmed in the step S508 that the stack cover 625 is closed, the succeeding processes are skipped, and the trimming sequence ends. Ordinarily, this is the process to be performed when the stack cover 625 is closed.

On the other hand, if it is confirmed in the step S508 that the "stacker open flag" is set to be 1, that is, if the stack cover 625 is opened, the "bundle standstill flag" is set in a step S509. Here, the setting of the "bundle standstill flag" indicates the state that the sheet bundle being conveyed is temporarily stopped in the conveying path by the opening of the stack cover 625.

After then, it is confirmed in a step S510 whether or not the stack cover 625 is closed. If the stack cover 625 is closed, the stopper 614 is moved back to continue the conveying operation of the sheet bundle (step S511), the conveying motor is again driven (step S512), and the set "bundle standstill flag" is cleared (step S513).

By performing the above control, in both the "non-trimming sequence" and the "trimming sequence", when the stack cover 625 is opened, the sheet bundle can be temporarily stopped in the conveying path immediately before the sheet discharge unit. Here, the position where the sheet bundle is temporarily stopped indicates the position where the trimming process is performed to the sheet bundle.

By temporarily stopping the sheet bundle in the conveying path immediately before the sheet discharge unit, all the processes immediately before the sheet discharge unit, have ended before the sheet bundle is temporarily stopped, whereby the sheet bundle can be conveyed to the sheet discharge unit immediately after restarting the operation (i.e., after the stack cover 625 is closed), and a processing time from the operation restart to the sheet discharge can be shortened.

Moreover, even when all the processes immediately before the sheet discharge unit have not been completed, if the sheet bundle has been conveyed to the area in the vicinity of the sheet discharge unit and is standstill, the sheet bundle can be conveyed to the sheet discharge unit immediately after the driving is restarted and the sheet process ends, whereby the processing time from the operation restart to the sheet discharge can be shortened.

Then, when the stack cover 625 is closed, the discharge operation of the sheet bundle is automatically restarted. That is, after the plural sheet bundles discharged to the stack tray 621 are taken out by the user, to be precise, after a series of the operations, "the opening of the stack cover 625→the takeout of the sheet bundle→the closing of the stack cover 625" have been executed by the user, the apparatus (trimmer 600) can automatically "stop" and then "restart" the conveying of the sheet bundle. Therefore, as compared with the case where the overall apparatuses constituting the image forming system are set to be in the jam state only due to the opening of the stack cover, both the productivity and the operability are remarkably improved in the embodiment.

Figure 19:
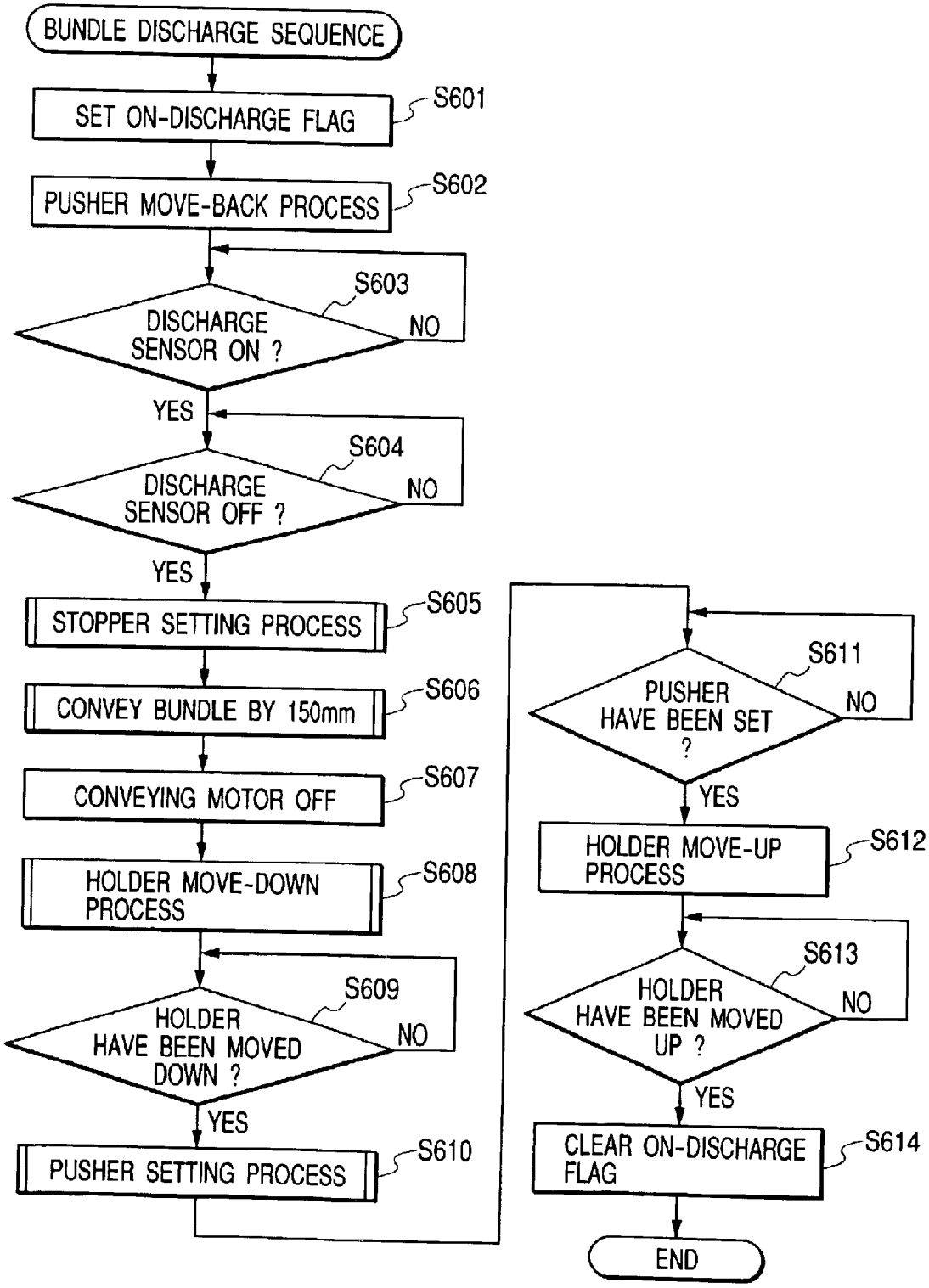
FIG. 19 is a flow chart showing a bundle discharge sequence.

Next, the "trimmer bundle discharge sequence" in the step S306 of FIG. 16 being the process to discharge the sheet bundle to the sheet discharge unit of the trimmer 600 will be explained in detail with reference to the flow chart shown in FIG. 19.

First, in a step S601, a "bundle on-discharge flag" representing that the sheet bundle is being discharged is set, and the pusher plate 619 is moved back to convey the sheet bundle to the stack unit (step S602). Then, it is confirmed whether the sheet discharge sensor 624 is turned on or off to detect the leading edge and the trailing edge of the sheet bundle by the sheet discharge sensor 624 (steps S603 and S604). When the trailing edge of the sheet bundle passes the sheet discharge sensor 624, the setting of the stopper 614 is performed for the succeeding sheet bundle (step S605), the sheet bundle is conveyed by 150 mm to be completely discharged, the conveying motor is then stopped (step S607), and the holder plate 618 is lowered to hold the sheet discharge unit (steps S608 and S609). After then, the discharged sheet bundle is pushed toward the stack unit by the pusher plate 619 (steps S610 and S611), and the holder plate 618 is moved up (step S612). After the holder plate 618 is moved up (step S613), the "bundle on-discharge flag" is cleared (step S614), whereby the "trimmer bundle discharge sequence" ends.

Figure 20:
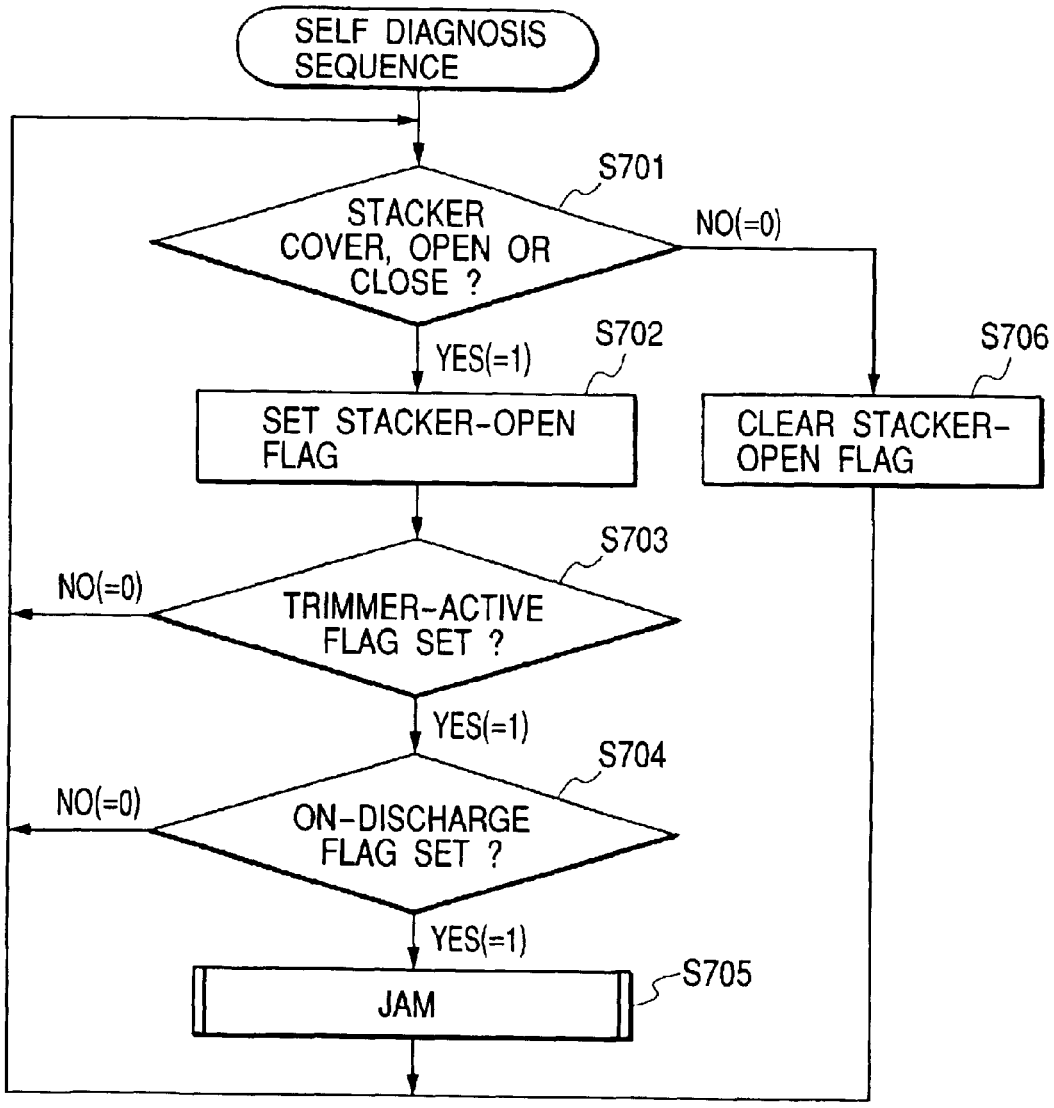
FIG. 20 is a flow chart showing a self diagnosis sequence.

Next, the self diagnosis sequence of the trimmer 600 will be explained with reference to the flow chart shown in FIG. 20.

In a step S701, it is observed whether the stack cover 625 is in the open state or in the close state. If the stack cover 625 is closed, the "stacker open flag" representing the state that the stack cover 625 is opened is cleared (step S706), and the flow returns to the step S701. On the other hand, if the stack cover 625 is opened, the "stacker open flag" is set (step S702), and the "trimmer-active flag" is discriminated in a step S703. Here, if the trimmer 600 is not active, the value of the "trimmer-active flag" is 0, whereby the flow returns to the step S701. On the other hand, if the trimmer 600 is active, the "bundle on-discharge flag" is discriminated (step S704). Moreover, if the trimmer 600 is not in the sheet bundle discharge process, the value of the "bundle on-discharge flag" is 0, whereby the flow returns to the step S701. Conversely, if the trimmer 600 is in the sheet bundle discharge process, the value of the "bundle on-discharge flag" is 1, whereby the driving system of the trimmer 600 is stopped and the "jam state" is set (step S705).

That is, in the case where the stack cover 625 is opened by the user while the trimmer 600 is processing the sheet bundle in the sheet discharge unit, the process in the sheet discharge unit is set to be in the jam state as the conveying abnormality of the sheet bundle so as to improve the safety when the user takes out the sheet bundle. Here, in order to stop the driving systems of the overall motors in the sheet discharge unit of the trimmer 600, the state of the sheet bundle discharge process can be promptly changed to the standstill state. That is, the driving system circuit in the sheet discharge unit is disconnected according to that the stack cover 625 is opened, so as to improve the safety when the user takes out the sheet bundle. By doing so, since the sheet bundle can not be appropriately conveyed, the jam state is set.

In the case where the stack cover is opened while the trimmer 600 is operating, if the sheet bundle is not being discharged, the operation can be stopped after continuing the sheet process until the stop position before the sheet discharge unit without immediately stopping the driving system of the trimmer 600 as the abnormal state (jam), whereby it is possible to prevent as much as possible to interrupt or stop the sheet process of the sheet bundle due to the opening of the stack cover 625 of the stack unit.

What is claimed is:

1. A sheet processing apparatus comprising:

sheet conveying means for conveying a sheet;

sheet processing means for performing a predetermined process to the sheet conveyed by said sheet conveying means;

sheet discharge means for performing a discharge process to the sheet processed by said sheet processing means;

stack means for stacking the sheets discharged by said sheet discharge means;

cover means for covering said stack means;

open/close detecting means for detecting whether said cover means is opened or closed; and control means for immediately stopping, in a case where the discharge process to the sheet is performed by said sheet discharge means, driving of said sheet discharge means and said sheet conveying means according to the detection by said open/close detecting means that said cover means is opened, and for continuing, in a case where the discharge process to the sheet is not performed by said sheet discharge means, the driving of said sheet conveying means even when the detection by said open/close detecting means is that said cover means is opened.

2. A sheet processing apparatus according to claim 1, wherein said control means stops, in the case where the discharge process to the sheet is performed by said sheet discharge means, said sheet discharge means and said sheet conveying means according to the detection by said open/close detecting means that said cover means is opened, and continues, in the case where the discharge process to the sheet is not performed by said sheet discharge means, the driving of said sheet conveying means and said sheet processing means in spite of the detection by said open/close detecting means that said cover means is opened.

3. A sheet processing apparatus according to claim 1, wherein said predetermined process is a cutout process to cut out the end of the sheet.

4. A sheet processing apparatus according to claim 1, wherein said sheet processing apparatus is an image forming apparatus.

* * * * *

UNITED STATES PATENT AND TRADEMARK OFFICE

CERTIFICATE OF CORRECTION

PATENT NO. : 6,826,374 B2
DATED : November 30, 2004
INVENTOR(S) : Hitoshi Kato et al.

It is certified that error appears in the above-identified patent and that said Letters Patent is hereby corrected as shown below:

Column 1,
Line 35, “can not” should read -- cannot --.

Column 9,
Line 16, “starts” should read -- start --.

Column 17,
Line 53, “can not” should read -- cannot --.

Signed and Sealed this

Twelfth Day of April, 2005

JON W. DUDAS
*Director of the United States Patent and Trademark Office*